US007792447B2

(12) United States Patent
Toyonori et al.

(10) Patent No.: US 7,792,447 B2
(45) Date of Patent: Sep. 7, 2010

(54) IMAGE HEATING APPARATUS WITH TEMPERATURE CONTROL IN RELATION TO GLASS TRANSITION OF TONER

(75) Inventors: Masatsugu Toyonori, Mishima (JP); Tomohito Ishida, Suntou-gun (JP); Tetsuya Atsumi, Susono (JP); Isami Itoh, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/270,275

(22) Filed: Nov. 13, 2008

(65) Prior Publication Data

US 2009/0067869 A1 Mar. 12, 2009

Related U.S. Application Data

(63) Continuation of application No. PCT/JP2008/060409, filed on May 30, 2008.

(30) Foreign Application Priority Data

Jun. 1, 2007 (JP) ..... 2007-146518
May 28, 2008 (JP) ..... 2008-139167

(51) Int. Cl.
*G03G 15/20* (2006.01)

(52) U.S. Cl. ..... 399/67; 399/341

(58) Field of Classification Search ..... 399/67, 399/341, 342

See application file for complete search history.

(56) References Cited

U.S. PATENT DOCUMENTS 5,114,520 A * 5/1992 Wang et al. ..... 156/240
2002/0102118 A1* 8/2002 Kosugi et al. ..... 399/341
2004/0057741 A1 3/2004 Uehara et al.
2004/0067082 A1 4/2004 Uehara et al.
2006/0251451 A1 11/2006 Ishigami et al.
2007/0086803 A1 4/2007 Kimura et al.
2008/0012927 A1 1/2008 Kimura et al.

FOREIGN PATENT DOCUMENTS

JP 2001-075414 3/2001
JP 2003-167459 6/2003
JP 2004-139039 5/2004
JP 2004-139040 5/2004
JP 2006-285020 10/2006
WO 2005/103837 11/2005

* cited by examiner

*Primary Examiner*—David M Gray
*Assistant Examiner*—Roy Yi
(74) *Attorney, Agent, or Firm*—Fitzpatrick, Cella, Harper & Scinto

(57) ABSTRACT

An image heating apparatus for allowing a surface of a heated toner image borne on a recording material to be glossed without generating a batter in the heated toner image is provided. In an image heating apparatus (9) including heating means (11 and 12) for heating an unfixed toner image (ta) borne on a recording material (P) and pressure means (21 and 22) for pressurizing an unfixed toner image (tb) heated by the heating means to gloss a surface of the unfixed toner image, the pressure means includes: pressure force changing means (54L and 54R) for changing a pressure force when the pressure means pressurizes the unfixed toner image; temperature detecting means (51 and 52) for detecting a temperature of the pressure means; and pressurization control means (53). The pressurization control means controls the pressure changing means according to temperature information of the temperature detecting means to change the pressure force of the pressure means before the pressure means pressurizes the unfixed toner image.

3 Claims, 18 Drawing Sheets

IMAGE HEATING APPARATUS WITH TEMPERATURE CONTROL IN RELATION TO GLASS TRANSITION OF TONER

This application is a continuation of International Application No. PCT/JP2008/060409 filed on May 30, 2008, which claims the benefit of Japanese Patent Application Nos. 2007-146518 filed on Jun. 1, 2007, and 2008-139167 filed on May 28, 2008.

BACKGROUND OF THE INVENTION

1. Field of the Invention

The present invention relates to an image heating apparatus suitable for use as an image heating/fixing apparatus (fixing device) mounted to an image forming apparatus such as an electrophotographic copying machine and an electrophotographic printer.

2. Description of the Related Art

An image forming apparatus such as an electrophotographic copying machine or printer is required to have higher image quality, and therefore, a density of a recording resolution becomes higher and higher to be 1200 dpi, 2400 dpi, 3600 dpi and the like.

In the above-mentioned image forming apparatus, light is radiated by a laser beam onto an outer peripheral surface (surface) of a drum-shaped electrophotographic photosensitive member (hereinafter, referred to as photosensitive drum). An image (electrostatic latent image) is recorded onto a surface of the photosensitive drum by the amount of radiated light at that time. On the surface of the photosensitive drum, all types of images ranging from a binary image such as a character to an image containing a halftone such as a picture can be formed. For reproducing a neutral density at this time, an image processing technique such as a pulse-width modulation system (PWM system), a dither method or a density pattern method is used to enable the formation of various patterns on the surface of the photosensitive drum.

Moreover, for the above-mentioned image forming apparatus, the reproducibility of a fine line pattern such as a small point size character becomes an issue with a recent increase in recording density and a recent demand for higher image quality. On the other hand, when the image containing the halftone such as the picture is output on a high-gloss recording material such as coated paper, an output of a high-gloss image at a gloss level close to that of the recording material with little unevenness in gloss is an issue. In order to resolve the issues, various technologies have been proposed.

Japanese Patent Application Laid-Open No. 2004-139039 describes a fixing device including heating and temporarily fixing means and image gloss control means. The heating and temporarily fixing means provides at least heat for a recording material, on which an unfixed toner image is formed, to soften or melt a toner of the unfixed toner image. Then, while the toner image is in a deformable state by an external force, the image gloss control means pressurizes the toner image without heating to gloss the toner image. Moreover, for keeping a temperature of the image gloss control means constant when images are continuously output, the temperature of the image gloss control means is controlled to be kept to a given temperature or lower by cooling means such as a cooling fan.

SUMMARY OF THE INVENTION

Problems to be Solved by the Invention

The fixing device to be mounted in the electrophotographic image forming apparatus is desired to prevent the generation of a batter of the toner in the unfixed toner image when the unfixed toner image is pressurized to gloss the surface of the unfixed toner image borne on the recording material. This is because, when the batter is generated in the toner, the deterioration of graininess of the image containing the halftone, the thickening or blur of a thin line, and the degradation of visibility of a small point size character are brought about.

In Japanese Patent Application Laid-Open No. 2004-139039 described above, a sufficient gloss can be put on the toner image on the recording material. However, Japanese Patent Application Laid-Open No. 2004-139039 described above does not take the deterioration of graininess, the thickening or blur of the thin line, and the degradation of visibility of the small point size character due to the batter of each pixel of the image into consideration.

An object of the present invention is to provide an image heating apparatus which can gloss a surface of an unfixed toner image without generating a batter in an unfixed toner image borne on a recording material.

As a configuration to achieve the object of the present invention, a fixing device includes: a first nip portion forming unit for forming a first nip portion for nipping and conveying a recording material; and a second nip portion forming unit for forming a second nip portion for nipping and conveying the recording material having passed through the first nip portion. The fixing device is for heating an unfixed toner image on the recording material in the first nip portion and for glossing the toner image on the recording material in the second nip portion. The fixing device further includes: a temperature detecting section for detecting a temperature of the second nip portion forming unit; a pressure force changing section for changing a pressure force applied to the second nip portion; and a control section for controlling the pressure force changing section. A peak value of the pressure force in the second nip portion is set to 8 kg/cm$^2$ or lower. A temperature of the toner image on the recording material drops from a temperature higher than a glass transition point of a toner to a temperature lower than the glass transition point within a period in which the toner image passes through the second nip portion. The control section controls the pressure force changing section to decrease the pressure force applied to the second nip portion as a detected temperature detected by the temperature detecting section becomes higher.

According to the present invention, the image heating apparatus which can gloss the surface of the toner image without generating the batter in the toner image can be provided.

Further features of the present invention will become apparent from the following description of exemplary embodiments with reference to the attached drawings.

DESCRIPTION OF THE EMBODIMENTS

The present invention is described with reference to the drawings.

Embodiment 1

(1) Example of Image Forming Apparatus

Figure 1:
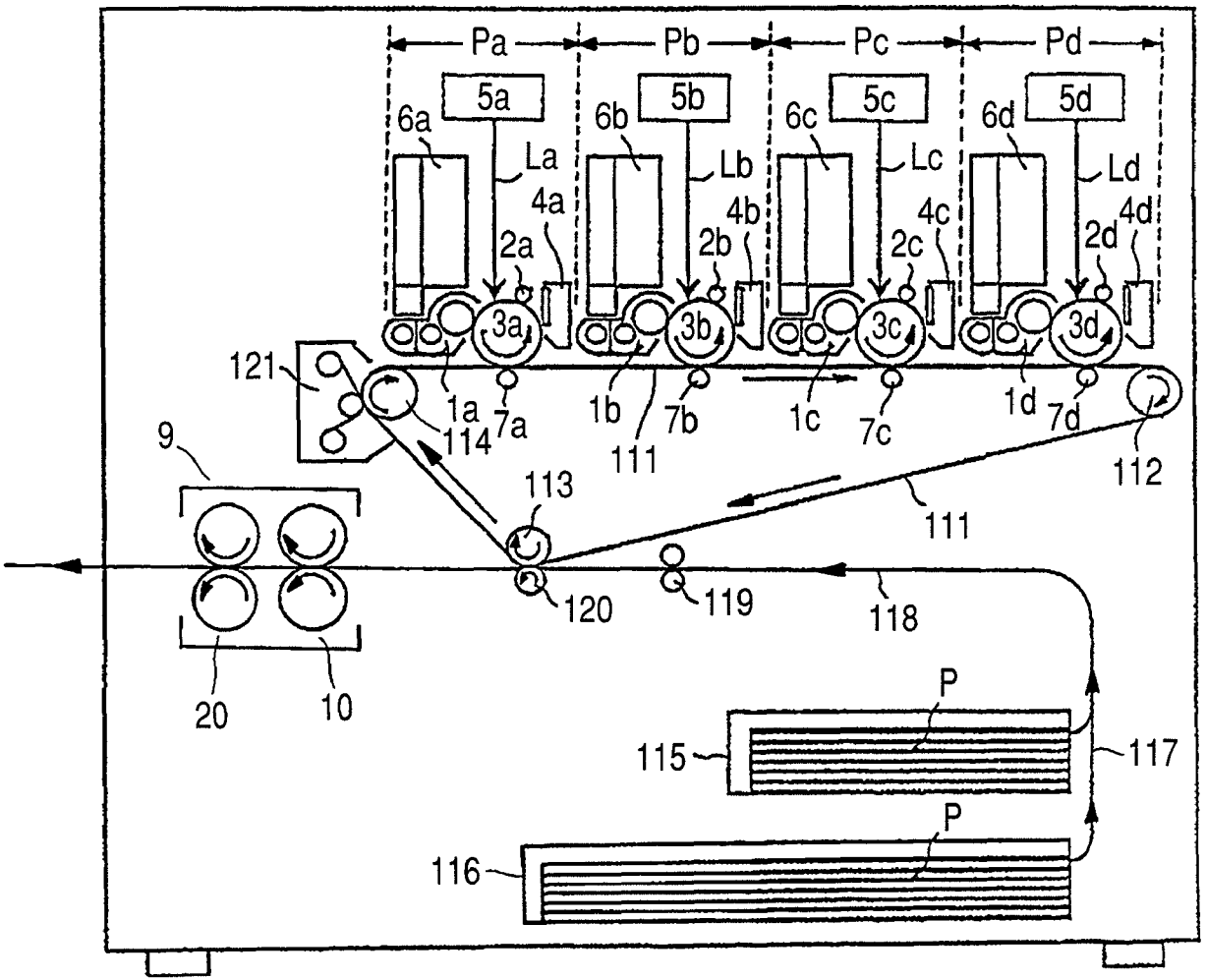
FIG. 1 is a schematic configuration diagram of an example of an image forming apparatus.

FIG. 1 schematically illustrates an example of a structure of an image forming apparatus capable of mounting an image heating apparatus according the present invention as an image heating/fixing apparatus. This image forming apparatus is a tandem type color laser printer employing an electrophotographic process.

The image forming apparatus illustrated In this example includes four image forming sections, that is, a first image forming section Pa, a second image forming section Pb, a third image forming section Pc, and a fourth image forming section Pd. Toner images of different colors are respectively formed in the four image forming sections Pa, Pb, Pc and Pd through a process of a latent image, development, and transfer.

The image forming sections Pa, Pb, Pc and Pd respectively include drum-shaped electrophotographic photosensitive members (hereinafter, referred to as photosensitive drums) 3*a*, 3*b*, 3*c* and 3*d* serving as image bearing members. When an image output is started, toner images of the respective colors are formed on the respective outer peripheral faces (surfaces) of the photosensitive drums 3*a*, 3*b*, 3*c* and 3*d*. An intermediate transfer belt 111 serving as an intermediate transfer member is provided to be adjacent to each of the surfaces photosensitive drums 3*a*, 3*b*, 3*c* and 3*d*. The toner images of the respective colors, which are formed on the surfaces of the photosensitive drums 3*a*, 3*b*, 3*c* and 3*d*, are primarily transferred onto an outer peripheral face (surface) of the intermediate transfer belt 111 and then is transferred to a recording material P in a secondary transfer section. The recording material P, onto which the toner image is transferred, is further introduced into an image heating/fixing apparatus 9 to fix the toner image, and is discharged as a recorded image forming material to a delivery tray (not shown) outside of the apparatus (end of the image output).

Around the surfaces of the photosensitive drums 3*a*, 3*b*, 3*c* and 3*d*, drum charging devices 2*a*, 2*b*, 2*c* and 2*d*, developing devices 1*a*, 1*b*, 1*c* and 1*d*, primary transfer charging devices 7*a*, 7*b*, 7*c* and 7*d*, and cleaners 4*a*, 4*b*, 4*c* and 4*d* are provided. In an upper part of the apparatus, laser scanners 5*a*, 5*b*, 5*c* and 5*d* are further provided.

The photosensitive drums 3*a*, 3*b*, 3*c* and 3*d* are rotationally driven in a direction indicated by arrows. As a result, the surfaces of the photosensitive drums 3*a*, 3*b*, 3*c* and 3*d* are uniformly primarily charged to have predetermined polarity and potential by the drum charging devices 2*a*, 2*b*, 2*c* and 2*d*.

Scanning exposure is performed with laser beams La, Lb, Lc and Ld output from the laser scanners 5*a*, 5*b*, 5*c* and 5*d*, each being modulated according to an image signal, on the uniformly charged faces of the respective surfaces of the photosensitive drums 3*a*, 3*b*, 3*c* and 3*d*. As a result, electrostatic latent images according to the image signals are formed on the respective surfaces of the photosensitive drums 3*a*, 3*b*, 3*c* and 3*d*. Specifically, each of the laser scanners 5*a*, 5*b*, 5*c* and 5*d* includes a light source device, a polygon mirror, an fθ-lens, and the like. Then, the laser scanners 5*a*, 5*b*, 5*c* and 5*d* scan the laser beams emitted from the light source devices by rotating the polygon mirrors. Beams of the scanning light are deflected by reflection mirrors, and are then focused by the fθ-lenses on generatrices on the surfaces of the photosensitive drums 3*a*, 3*b*, 3*c* and 3*d* for light exposure. As a result, latent images according to the image signals are formed on the surfaces of the photosensitive drums 3*a*, 3*b*, 3*c* and 3*d*.

The developing devices 1*a*, 1*b*, 1*c* and 1*d* are filled with predetermined amounts of a cyan toner, a magenta toner, a yellow toner, and a black toner as developers by toner supply devices 6*a*, 6*b*, 6*c* and 6*d*. The developing devices 1*a*, 1*b*, 1*c* and 1*d* respectively develop the latent images on the surfaces of the photosensitive drums 3*a*, 3*b*, 3*c* and 3*d* to visualize the latent images as a cyan toner image, a magenta toner image, a yellow toner image, and a black toner image.

The intermediate transfer belt 111 is an endless belt looped around three parallel rollers 112, 113 and 114 in a tensed manner, and is rotationally driven in a direction indicated by arrows at the same circumferential speed as that of the photosensitive drums 3*a*, 3*b*, 3*c* and 3*d*.

The yellow toner image corresponding to a first color, which is formed and borne on the surface of the photosensitive drum 3*a* of the first image forming section Pa, is primarily transferred onto the surface of the intermediate transfer belt 111 while passing through a nip portion formed by bringing the surface of the photosensitive drum 3*a* and the surface of the intermediate transfer belt 111 in contact with each other. Specifically, the yellow toner image is transferred onto the surface of the intermediate transfer belt 111 by an electric field formed by a primary transfer bias applied to the primary transfer charging device 7*a* and a pressure.

Similarly, the magenta toner image corresponding to a second color, the cyan toner image corresponding to a third color and the black toner image corresponding to a fourth color, which are formed and borne on the surfaces of the photosensitive drums 3*b*, 3*c* and 3*d* of the second, third and fourth image forming sections Pb, Pc and Pd, are transferred onto the surface of the intermediate transfer belt 111 in an overlapping manner. As a result, a composite color toner image corresponding to a target color image is formed on the surface of the intermediate transfer belt 111.

The reference numeral 120 denotes a secondary transfer roller. The secondary transfer roller 120 is brought into contact with the roller 113 among the three rollers 112, 113 and 114, around which the intermediate transfer belt 111 is looped in a tensed manner, by a pressure through the intermediate transfer belt 111 interposed therebetween, thereby forming a secondary transfer nip portion with the intermediate transfer belt 111.

On the other hand, a predetermined recording material P of different types of the recording materials P housed in a stacked manner in two feed cassettes 115 and 116 are fed separately in a one-by-one fashion from the feed cassette 115 or 116 to be conveyed to registration rollers 119 through sheet paths 117 and 118. The registration rollers 119 feed the recording material P to the secondary transfer nip portion at predetermined timing. A secondary transfer bias is applied to the secondary transfer roller 120 from a bias power source (not shown). As a result, the composite color toner image transferred onto the surface of the intermediate transfer belt 111 in an overlapping manner is transferred to a surface of the recording material P at a time.

The recording material P, onto which the composite color toner image is transferred in the secondary transfer nip portion, is separated from the surface of the intermediate transfer belt 111.

The surfaces of the photosensitive drums 3*a*, 3*b*, 3*c* and 3*d* after the termination of the primary transfer are cleaned by removing transfer residual toners respectively by the cleaners 4*a*, 4*b*, 4*c* and 4*d*, and are continuously used for next image formation.

The toners and other foreign materials remaining on the surface of the intermediate transfer belt 111 are wiped off by abutting a cleaning web (non-woven fabric) 121 against the surface of the intermediate transfer belt 111.

(2) Fixing Device 9

Figure 2:
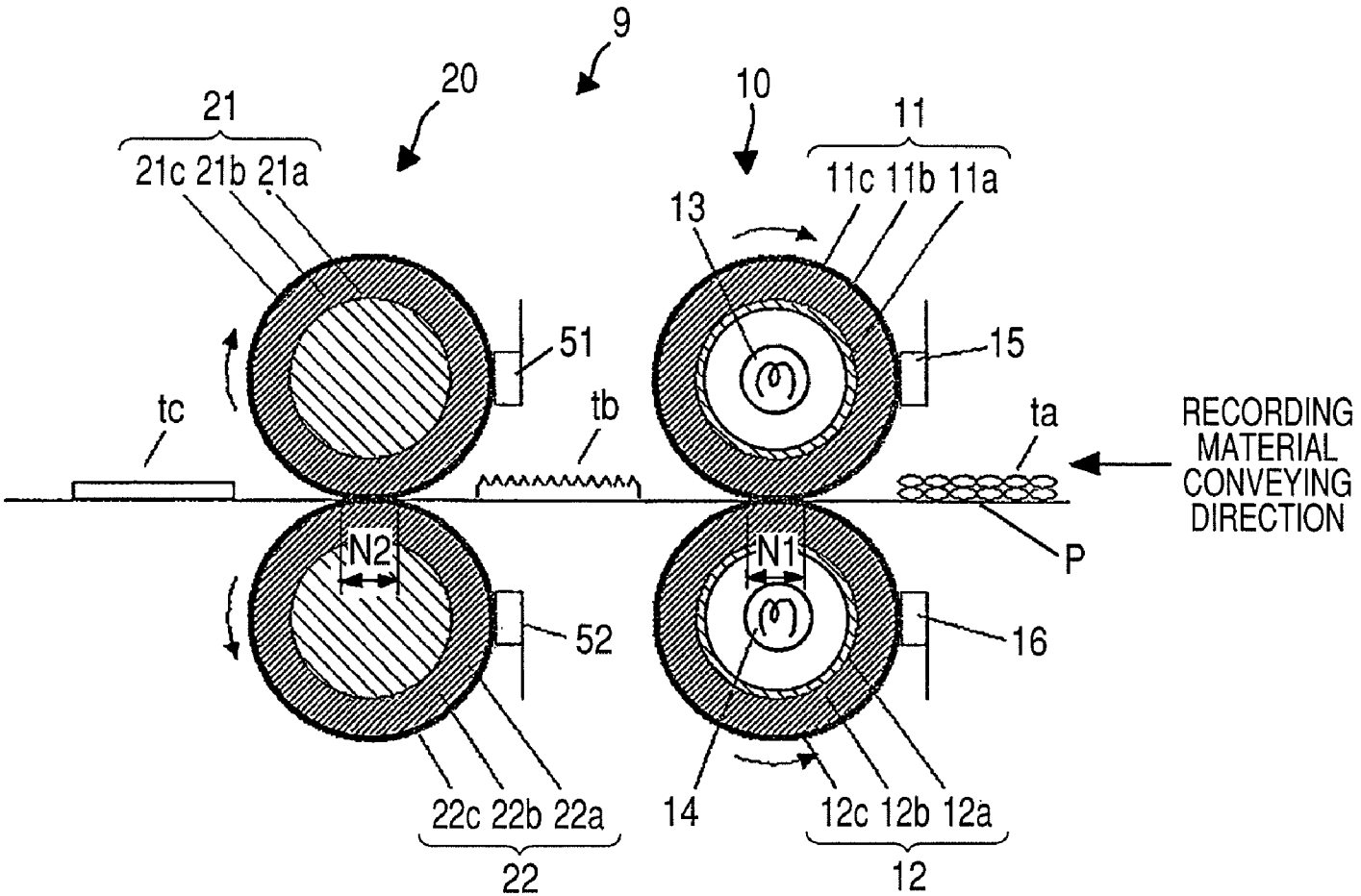
FIG. 2 is a schematic horizontal cross-sectional view of an example of a fixing device of Embodiment 1.
Figure 3:
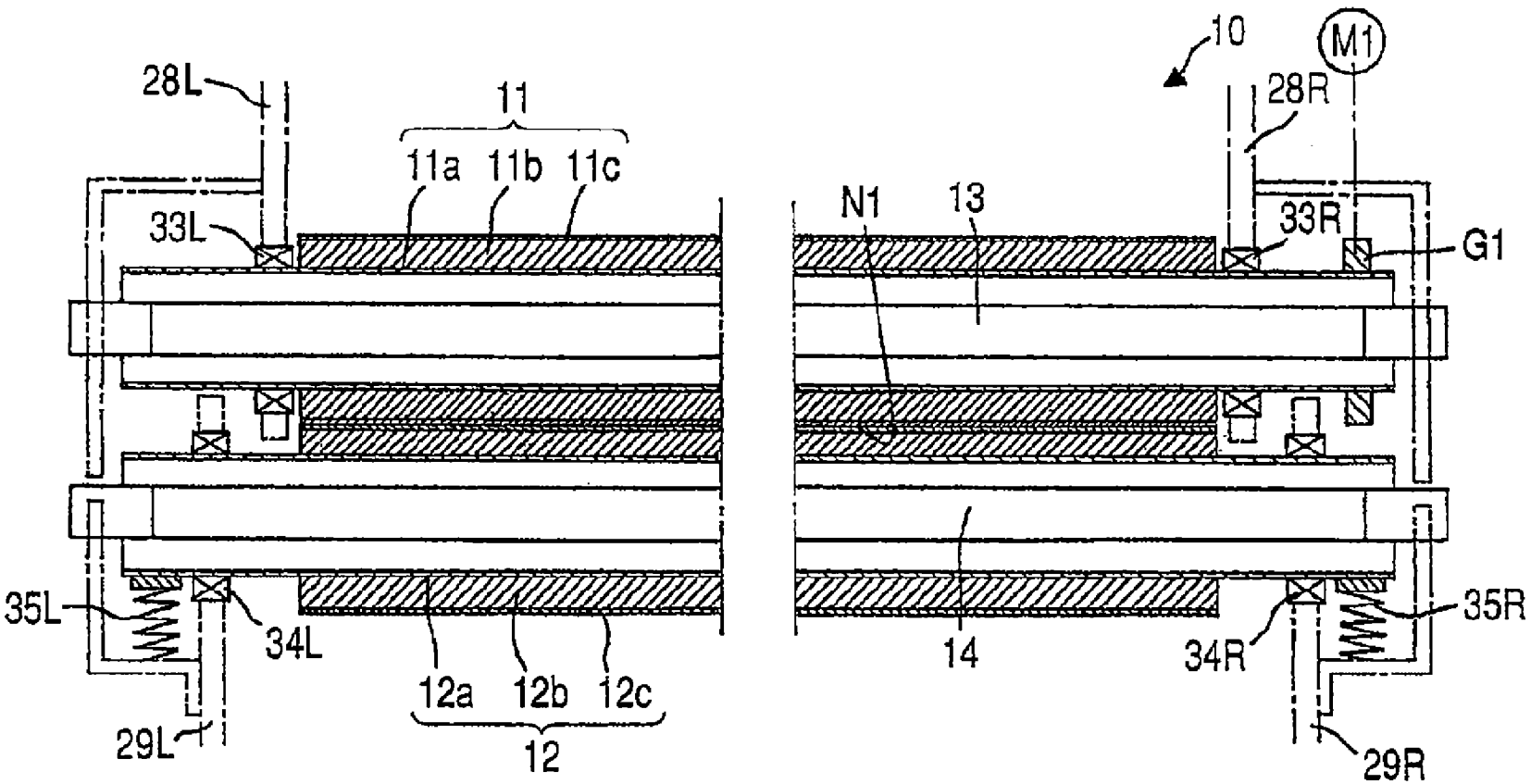
FIG. 3 is a schematic vertical cross-sectional view of an image heating apparatus of the fixing device of Embodiment 1.
Figure 4:
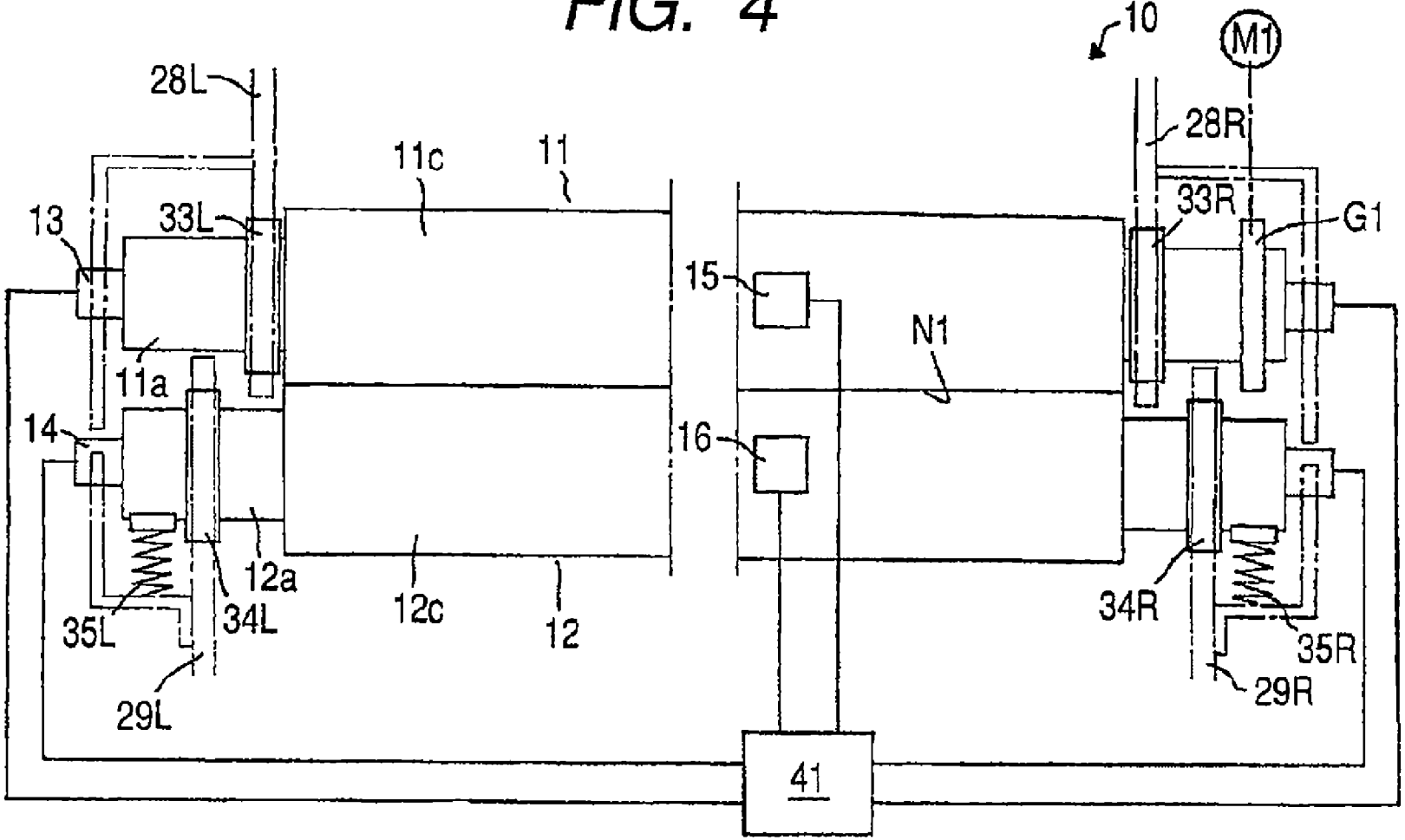
FIG. 4 is a view illustrating the image heating apparatus viewed from the introduction side of a recording material.
Figure 5:
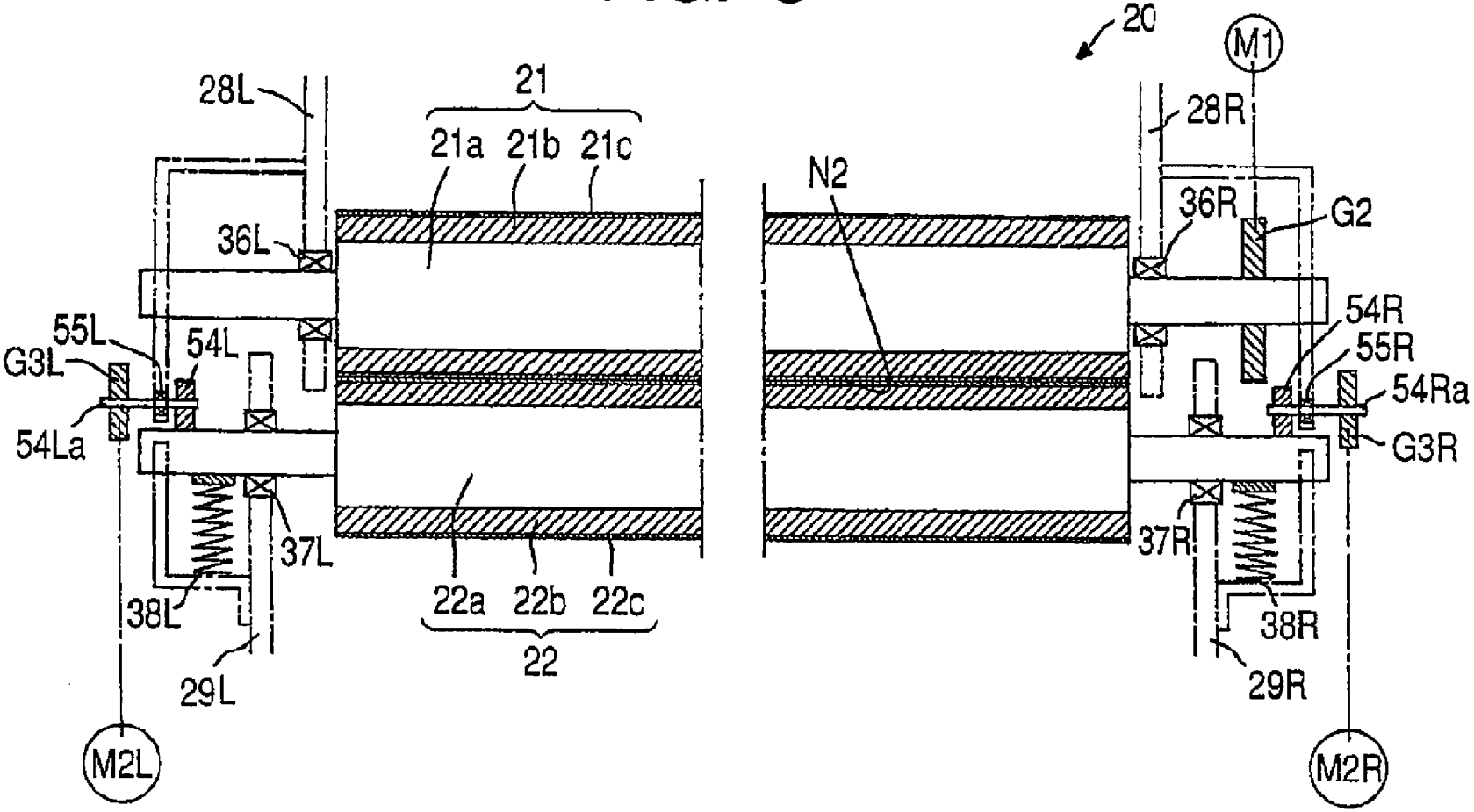
FIG. 5 is a schematic vertical cross-sectional view of an image pressure device of the fixing device of Embodiment 1.
Figure 6:
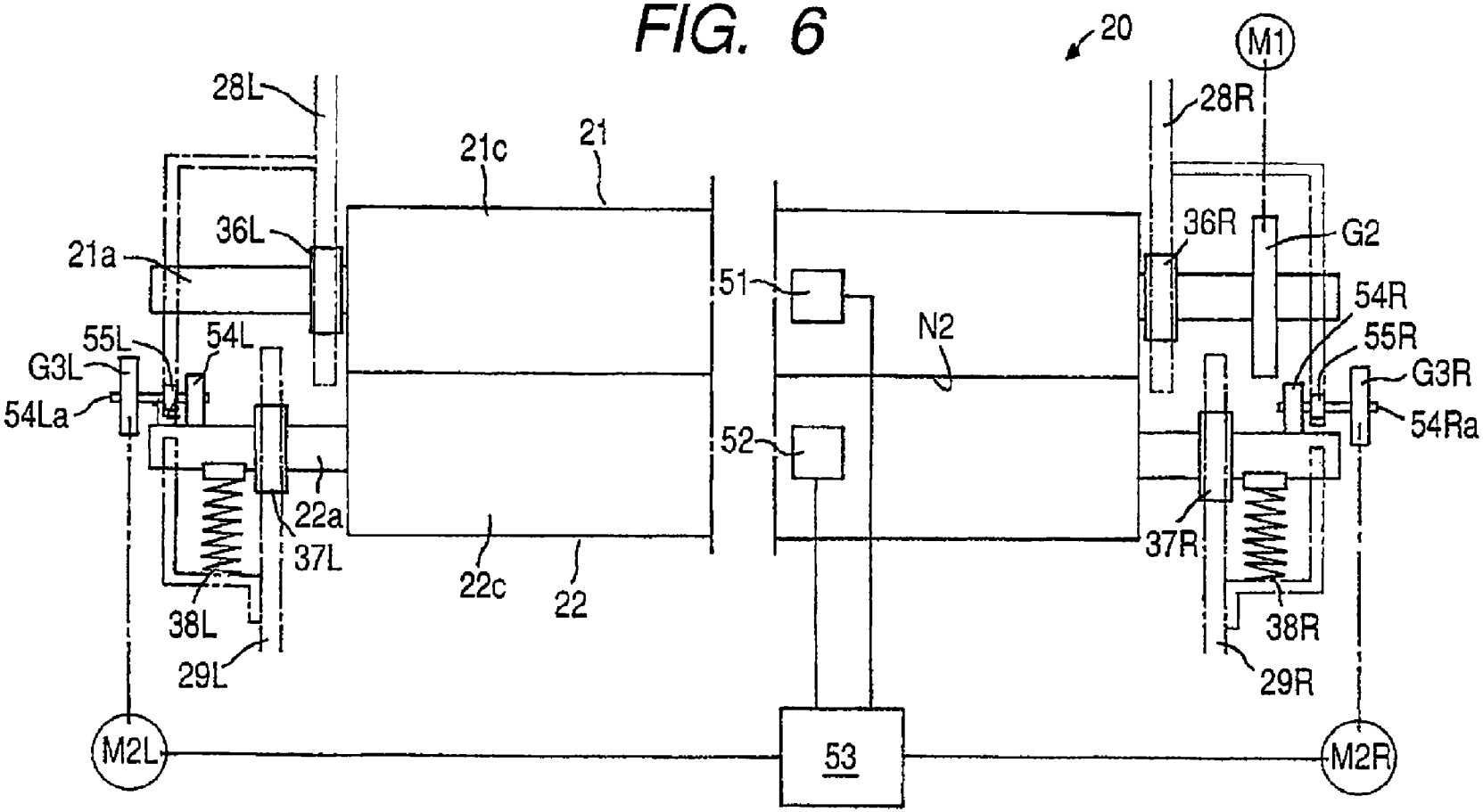
FIG. 6 is a view illustrating the image pressure device viewed from the introduction side of the recording material.

FIG. 2 is a schematic cross-sectional view of an example of the fixing device 9. FIG. 3 is a schematic longitudinal sectional view of an image heating apparatus (first nip portion forming unit) 10 in the fixing device 9. FIG. 4 is a view illustrating the image heating apparatus 10 viewed from the introduction side of the recording material P. FIG. 5 is a schematic longitudinal sectional view of an image pressure device (second nip portion forming unit) 20 in the fixing device 9. FIG. 6 is a view illustrating the image pressure device 20 viewed from the introduction side of the recording medium P.

In the following description, for the fixing device and members constituting the fixing device, a longitudinal direction is a direction perpendicular to a recording material conveying direction on the surface of the recording material. A transverse direction is a direction parallel to the recording material conveying direction on the surface of the recording material. A length indicates size in the longitudinal direction, whereas a width indicates size in the transverse direction.

The fixing device 9 described In this example includes the image heating apparatus 10 incorporating a heat source therein and the image pressure device 20 without including any heat source. The heating device 10 includes a fixing roller 11 and a pressure roller 12. The pressure device 20 is provided on the downstream side of the heating device 10 in the recording material conveying direction. The pressure device 20 includes a fixing roller 21 and a pressure roller 22.

Here, the fixing roller 11 and the pressure roller 12 of the heating device 10 are heating means for heating an unfixed toner image borne on the recording material P. The fixing roller 21 and the pressure roller 22 of the heating device 20 are pressure means for pressurizing the toner image heated by the fixing roller 11 and the pressure roller 12 of the heating device 10 to gloss the surface of the toner image heated by the heating device 10.

2-1) Heating Device (First Nip Portion Forming Unit) 10

The fixing roller 11 includes a cored bar 11*a* formed in a hallow cylinder elongated in the longitudinal direction. An elastic layer 11*b* is provided on an outer circumference of the cored bar 11*a* except for both ends thereof. A release layer 11*c* is provided on an outer circumference of the elastic layer 11*b*. A material of the release layer 11*cc* is FRP or a fluorine resin such as PFA or PTFE. The release layer 11*c* is formed by coating the outer circumference of the elastic layer 11*b* with the fluorine resin or by using a tube thereof on the outer circumference of the elastic layer 11*b*. The elastic layer 11*b* can follow a variation in thickness (several to several tens of μm) of the toner image, and serves to ensure a first nip portion N1 between the fixing roller 11 and the pressure roller 12. Therefore, a silicone rubber or a fluorine rubber having elasticity is used as a material of the elastic layer 11*b*. When the elasticity of the elastic layer 11*b* is small, a decrease in image quality such as insufficient fixation of a concave portion of the unifixed toner image or the deterioration of graininess due to a batter of the toner is brought about. Therefore, a predetermined degree of eleasticity is required. The cored bar 11*a* is formed in a hollow cylinder by using a material such as aluminum. Both ends thereof are rotatably held by device frames 28L and 28R of the fixing device 9 through bearings 33L and 33R. In a hollow of the cored bar 11*a*, a halogen heater 13 elongated in the longitudinal direction is enclosed. Both ends of the heater 13 are held by the device frames 28L and 28R. The amount of heat necessary for melting and deforming an unfixed toner image ta borne on the recording material P to temporarily fixe the unfixed toner image onto the recording material P is supplied by the hater 13 to the fixing roller 11.

Similarly to the fixing roller 11, the pressure roller 12 includes a cored bar 12*a* formed in a hollow cylinder elongated in the longitudinal direction. An elastic layer 12*b* is provided on an outer circumference of the cored bar 12*a* except for both ends thereof. A release layer 12*c* is provided on an outer circumference of the elastic layer 12*b*. Materials of the cored bar 12*a*, the elastic layer 12*b*, and the release layer 12*c* are the same as those of the cored bar 11*a*, the elastic layer 11*b*, and the release layer 11*c* of the fixing roller 11. The pressure roller 12 is provided below the fixing roller 11 to be parallel to the fixing roller 11. Both ends of the cored bar 12*a* are rotatably and vertically movably held by device frames 29L and 29R through bearings 34L and 34R. The pressure roller 12 is pressurized toward the fixing roller 11 side by pressure springs (pressure members) 35L and 35R provided between both ends of the cored bar 12*a* and the device frames 29L and 29R. The pressurization brings the release layer 12*c* of the pressure roller 12 into contact with the release layer 11*c* of the fixing roller 11 to elastically deform the elastic layer 12*b* of the pressure roller 12 and the elastic layer 11*b* of the fixing roller 11. As a result, the nip portion (hereinafter, referred to as a heating nip portion or a first nip portion) N1 for heating the unfixed toner image ta borne on the recording material P is formed between the outer circumferential face (surface) of the pressure roller 12 and the outer circumferential face (surface) of the fixing roller 11. In a hollow of the cored bar 12*a*, a halogen heater 14 elongated in the longitudinal direction is included. Both ends of the heater 14 are held by the device frames 29L and 29R. The amount of heat necessary for temporarily fixing the unfixed toner image to borne on the recording material P onto the recording material P is supplied to the pressure roller 12 by the heater 14.

2-2) Pressuring Device (Second Nip Portion Forming Unit) 20

The fixing roller 21 includes a cored bar 21*a* formed as a solid round shaft elongated in the longitudinal direction. An elastic layer 21*b* is provided on an outer circumference of the cored bar 21*a* except for both ends thereof. A release layer 21*c* is provided on an outer circumference of the elastic layer 21*b*. A material of the release layer 21*c* is FRP or a fluorine resin such as PFA or PTFE. The release layer 21*c* is formed by coating the outer circumference of the elastic layer 21*b* with the fluorine resin or by using a tube thereof on the outer circumference of the elastic layer 21*b*. The elastic layer 21*b* can follow a variation in thickness (several to several tens of μm) of the toner image, and serves to ensure a second nip portion N2 between the fixing roller 21 and the pressure roller 22. Therefore, a silicone rubber or a fluorine rubber having elasticity is used as a material of the elastic layer 21*b*. When the elasticity of the elastic layer 21*b* is small, a decrease in image quality such as the deterioration of graininess due to the batter of the toner is brought about. Therefore, a predetermined degree of elasticity is required. Both ends of the cored bar 21*a* are rotatably held by the device frames 28L and 28R through bearings 36L and 36R.

Similarly to the fixing roller 21, the pressure roller 22 includes a cored bar 22*a* formed in a solid round shaft elongated in the longitudinal direction. An elastic layer 22*b* is provided on an outer circumference of the cored bar 22*a* except for both ends thereof. A release layer 22*c* is provided on an outer circumference of the elastic layer 22*b*. Materials of the cored bar 22*a*, the elastic layer 22*b*, and the release layer 22*c* are the same as those of the cored bar 21*a*, the elastic layer 21*b*, and the release layer 21*c* of the fixing roller 21. The pressure roller 22 is provided below the fixing roller 21 to be parallel to the fixing roller 21. Both ends of the cored bar 22*a* are rotatably and vertically movably held by device frames 29L and 29R through bearings 37L and 37R. The pressure roller 22 is pressurized toward the fixing roller 21 side by pressure springs (pressure members) 38L and 38R provided between both ends of the cored bar 22*a* and the device frames 29L and 29R. The pressurization brings the release layer 22*c* of the pressure roller 22 into contact with the release layer 21*c* of the fixing roller 21 to elastically deform the elastic layer 22*b* of the pressure roller 22 and the elastic layer 21*b* of the fixing roller 21. As a result, the nip portion (hereinafter, referred to as a pressure nip portion or a second nip portion) N2 is formed between the outer circumferential face (surface) of the pressure roller 22 and the outer circumferential face (surface) of the fixing roller 21. A pressure force required for pressurizing a toner image tb heated by the above-mentioned heating device 10 to gloss a surface of the toner image tb is applied to the pressure roller 22 by the pressure springs 38L and 38R.

2-3) Heating/pressurization Operation of the Fixing Device 9

In the heating device 10, electric power is supplied from a power source section (not shown) of a temperature control section 41 (FIG. 4) serving as temperature control means to the heater 13 of the fixing roller 11 and the heater 14 of the pressure roller 12 to cause the heaters 13 and 14 to generate heat. The temperature control section 41 is formed of a memory such as a RAM or a ROM and a CPU. A temperature regulation table necessary for temperature control and various programs are stored in the memory. The heat generation from the heater 13 heats the cored bar 11*a*, the elastic layer 11*b*, and the release layer 11*c* of the fixing roller 11 to elevate the temperature of the surface of the fixing roller 11. The heat generation from the heater 14 also heats the cored bar 12*a*, the elastic layer 12*b*, and the release layer 12*c* of the pressure roller 12 to elevate the temperature of the surface of the pressure roller 12. The temperature of the fixing roller 11 is detected by a thermistor 15 (FIG. 4) serving as temperature detection means. An output signal (temperature information) from the thermistor 15 is loaded into the temperature control section 41. Moreover, the temperature of the pressure roller 12 is detected by a thermistor 16 (FIG. 4) serving as temperature detection means. An output signal (temperature information) from the thermistor 16 is loaded into the temperature control section 41. Though the thermistor 15 is in contact with the surface of the fixing roller 11, the thermistor 15 may also be in noncontact with the surface of the fixing roller 11. Though the thermistor 16 is contact with the surface of the pressure roller 12, the thermistor 15 may also be in contact with the surface of the pressure roller 12. The temperature control section 41 controls ON/OFF of the heaters 13 and 14 by a power supply control section (not shown) based on the signals from the thermistors 15 and 16 to keep the temperatures of the fixing roller 11 and the pressure roller 12 to a predetermined temperature (target temperature). Specifically, the temperature control section 41 keeps the temperatures of the fixing roller 11 and the pressure roller 12 to the predetermined temperature (target temperature) in order to heat the unfixed toner image ta borne on the recording material P to soften and melt the toner in the unfixed toner image.

Moreover, in the heating device 10, a drive gear G1 (FIG. 4) provided to one end of the cored bar 11*a* of the fixing roller 11 is rotationally driven by a fixing motor M1 serving as a driving source through a gear train (not shown). The rotational driving of the gear G1 rotates the fixing roller 11 in a direction indicated by an arrow (FIG. 2). The rotation of the fixing roller 11 is transmitted to the surface of the pressure roller 12 through the nip portion N1. In response to the rotation of the fixing roller 11, the pressure roller 12 follows the rotation to rotate in a direction indicated by an arrow (FIG. 2).

In the pressure device 20, a drive gear G2 (FIG. 6) provided to one end of the cored bar 21*a* of the fixing roller 21 is rotationally driven by a fixing motor M1 through a gear train (not shown). The rotational driving of the gear G2 rotates the fixing roller 21 in a direction indicated by an arrow (FIG. 2). The rotation of the fixing roller 21 is transmitted to the surface of the pressure roller 22 through the nip portion N2. In response to the rotation of the fixing roller 21, the pressure roller 22 follows the rotation to rotate in a direction indicated by an arrow (FIG. 2).

The fixing motor M1 is used commonly for the heating device 10 and the pressure device 20. The gear G1 and the gear train of the heating device 10 and the gear G2 and the gear train of the pressure device 20 are configured to cause the fixing rollers 11 and 21 and the pressure rollers 11 and 22 to rotate at the same circumferential speed (process speed).

In the state where the temperatures and the rotating states of the fixing roller 11 and the pressure roller 12 in the heating device 10 are stabilized while the rotating states of the fixing roller 21 and the pressure roller 22 in the pressure device 20 are stabilized, the recording material P is introduced to the nip portion N1 and the nip portion N2 in the stated order. The recording material P is nipped and conveyed by the surface of the fixing roller 11 and the surface of the pressure roller 12 in the nip portion N1. In the conveying process, the recording material P and the unfixed toner image ta are heated by the surface of the fixing roller 11 and the surface of the pressure roller 12. As a result, the unfixed toner image ta borne on the recording material P is softened and melted to be the toner image tb which is in a deformable state by an external force. Hereinafter, in order to distinguish the toner image tb and the unfixed toner image ta before being introduced into the nip portion N1 from each other, the toner image tb is referred to as the temporarily fixed toner image tb. The recording material P exiting from the nip portion N1 is nipped and conveyed by the surface of the fixing roller 21 and the surface of the pressure roller 22 in the nip portion N2. Then, the temporarily fixed toner image tb (FIG. 2) is pressurized by the surface of the fixing roller 21 and the surface of the pressure roller 22 to gloss the surface of the temporarily fixed toner image tb. As a result, the temporarily fixed toner image tb becomes a toner image tc (FIG. 2) which is fixed onto the recording material P and has a gloss on its surface. The recording material P exiting from the nip portion N2 is discharged to the delivery tray outside of the device.

In this example, there are some cases where the thermistor 16 is not provided to the pressure device 10. In this case, ON/OFF of the heaters 13 and 14 is controlled by the electric power supply control section based on the output signal from the thermistor 15 to keep the temperatures of the fixing roller 11 and the pressure roller 12 to the predetermined temperature.

Moreover, the toners for forming the unfixed toner image ta are not particularly limited, and toners having a general structure are used. In the case of a toner to which a release agent such as a wax is added, the heating device 10 as described above is used. However, in the case where a toner to which the release agent such as the wax is not added is used, it is desirable to apply a release agent such as a silicone oil onto the surface of the fixing roller 11. In this case, it is desirable to use a fixing roller having a surface layer in which the release agent such as the silicone oil easily impregnates without providing the release layer of the fluorine resin or the like as the fixing roller 11.

(3) Factor of Generation of the Batter in the Toner Image

As described above, the toner image tb borne on the recording material P is nipped and conveyed to be pressurized by the pressure device 20 while maintaining its deformable state by the external force. As a result, the surface of the toner image can be smoothened to improve a gloss level. If the toner image is excessively pressed, the graininess is degraded although the gloss level is improved. The amount (volume) of toner of each of the pixels constituting the toner image differs for each pixel. When the pressure force of the pressure device 20 is too large, a height of the toner of each of the pixels is pressed to be approximately the same. When the amount (volume) of toner differs for each pixel, a spread (area) of the toner differs for each pixel if the height of the toner is pressed to be the same. A difference in area for each pixel is a factor of the deteriorated graininess. Therefore, when the pressure force (nip pressure) applied to the temporarily fixed toner image tb in the nip portion N2 of the pressure device 20 is too large, for example, 16 to 21 kg/cm$^2$, the toners in the temporarily fixed toner image tb are pressed. In particular, when the recording material P is coated paper, the batter of the softened and melted toner is generated in a more remarkable manner because the softened and melted toner does not penetrate to paper fibers. When the batter of the toner is generated, the deterioration of graininess of the image containing a halftone, the thickening and blur of a thin line, and the visibility of a small point size character are brought about.

Moreover, when the multiple recording materials P are continuously introduced to the nip portions N1 and N2, the temperatures of the fixing roller 21 and the pressure roller 22 continue increasing by thermal energy accumulated in the temporarily fixed toner image tb which is in the deformable state by the external force and in the recording materials P. Therefore, if the unfixed toner image tb is continuously pressurized with a given pressure force, the toners are more likely to be pressed as the temperatures of the fixing roller 21 and the pressure roller 22 become higher. As a result, not only the deterioration of graininess but also unevenness in gloss of the toner image tc on each of the recording materials P are caused.

(4) Configuration for Changing the Pressure Force of the Image Pressure Device 20

The fixing device 9 of this embodiment has a configuration of changing the pressure force for pressurizing the temporarily fixed toner image tb with the fixing roller 21 and the pressure roller 22 according to the temperatures of the fixing roller 21 and the pressure roller 22. The timing of changing the pressure force is before the pressurization of the temporarily fixed toner image tb with the fixing roller 21 and the pressure roller 22.

In FIG. 6, reference numeral 51 denotes a thermistor serving as temperature detection means for detecting the temperature of the fixing roller 21. Reference numeral 52 denotes a thermistor serving as temperature detection means for detecting the temperature of the pressure roller 22. The thermistors (temperature detecting sections) 51 and 52 respectively detect the surface temperatures of the fixing roller 21 and the pressure roller 22 while the fixing device 9 is in a standby state (waiting state) and the fixing device 9 is performing a heating/pressurization operation. Here, the standby state of the fixing device 9 means a state where the image forming apparatus waits for an image formation start instruction while keeping an image formable state. Though the thermistor 51 is in contact with the surface of the fixing roller 21, the thermistor 51 may also be in noncontact with the surface of the fixing roller 21. Though the thermistor 52 is also in contact with the surface of the pressure roller 22, the thermistor 52 may be in noncontact with the surface of the pressure roller 22. Reference numeral 53 denotes a pressurization control section (control section) serving as pressurization control means. Reference numerals 54L and 54R are cams serving as pressure force changing means (pressure force changing sections). Reference numerals M2L and M2R are cam motors serving as driving sources.

Figure 7:
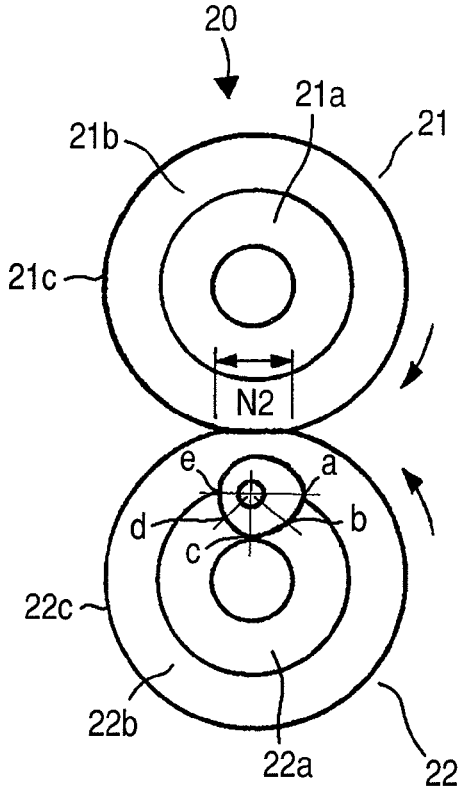
FIG. 7 is an explanatory view of an example of a cam.

The cam 54L includes a cam shaft 54La. The cam shaft 54La is rotatably held by the device frame 28L through a bearing 55L. The cam 54R includes a cam shaft 54Ra. The cam shaft 54Ra is rotatably held by the device frame 28R through a bearing 55R. The cams 54L and 54R are plate cams formed in the same shape. The cam 54L corresponding to one of the cams 54L and 54R is illustrated in FIG. 7. Each of the cams 54L and 54R has five cam faces a, b, c, d and e, each having a different radius of curvature, on the surface of each of the cams 54L and 54R (FIG. 7). The radii of curvature of the cam faces a, b, c, d and e are designed to satisfy: e>d>c>b>a. Specifically, the cams 54L and 54R change the pressure forces of the pressure springs 38L and 38R by changing a center distance between the fixing roller 21 and the pressure roller 22 against the pressure forces of the pressure springs 38L and 38R. The cam face a is used when the fixing device 9 is in the standby state. Each of the cam faces b, c, d and e is used to cause the pressure device 20 to perform the pressurization operation. Specifically, each of the cam faces a, b, c, d and e comes into contact with the surface of the cored bar 22*a* of the pressure roller 22. As a result, the cams 54L and 54R can change a peak pressure of the pressure force of the nip portion N2 in a multistep manner (five steps).

The pressurization control section 53 is formed of a memory such as a RAM or a ROM and a CPU. A table necessary for controlling the pressure force of the pressure device 20 and various programs are stored in the memory. The table contains data for judging whether the temperatures of the fixing roller 21 and the pressure roller 22 increase or decrease for each type of the recording material P used for the image forming apparatus and data for obtaining the amount of rotational driving of the cams 54L and 54R. After loading output signals (temperature information) of the thermistors 51 and 52, the CPU determines based on the signals according to the table whether the temperatures of the fixing roller 21 and the pressure roller 22 increase or decrease and also obtains the amount of rotational driving of the cams 54L and 54R. When the temperatures of the fixing roller 21 and the pressure roller 22 increase, control for reducing the pressure force of the pressure roller 22 is performed before the temporarily fixed toner image tb is pressurized by the fixing roller 21 and the pressure roller 22. Specifically, the CPU obtains the amount of rotational driving based on the output signals of the thermistors 51 and 52, and controls the rotations of the cam motors M2L and M2R based on the amount of rotational driving to rotate the cams 54L and 54R, thereby reducing the pressure force of the pressure roller 22. On the contrary, when the temperatures of the fixing roller 21 and the pressure roller 22 decrease, control for increasing the pressure force of the pressure roller 22 is performed before the temporarily fixed toner image tb is pressurized by the fixing roller 21 and the pressure roller 22. Specifically, the CPU obtains the amount of rotational driving based on the output signals of the thermistors 51 and 52, and controls the rotations of the cam motors M2L and M2R based on the amount of rotational driving to rotate the cams 54L and 54R, thereby increasing the pressure force of the pressure roller 22.

In this example, pressure changing means is not limited to the cams 54L and 54R. The pressure changing means may be configured to use a ball spring to change the center distance between the fixing roller 21 and the pressure roller 22.

An example of the fixing device 9 of this embodiment will be specifically described. However, the fixing device 9 of this embodiment is not limited to the fixing device 9 described below.

In the fixing device 9, specific configurations of the heating device 10 and the pressure device 20 are as follows.

- The fixing roller 11 of the heating device 10 and the fixing roller 21 of the pressure device 20: A diameter is 60 mm and a length is 330 mm. As a material of the cored bars 11*a* and 21*a*, aluminum was used. The cored bar was coated with a silicon rubber to a thickness of 2.5 mm as each of the elastic layers 11*b* and 21*b*. Each of the release layers 11*c* and 21*c* respectively provided on the elastic layers 11*b* and 21*b* is constituted by a PFA tube having a thickness of 50 μm.
- The pressure roller 12 of the heating device 10 and the pressure roller 22 of the pressure device 20: A diameter is 60 mm and a length is 330 mm. As a material of the cored bars 12*a* and 22*a*, aluminum was used. The cored bar was coated with a silicon rubber to a thickness of 1.5 mm as each of the elastic layers 12*b* and 22*b*. Each of the release layers 12*c* and 22*c* respectively provided on the elastic layers 12*b* and 22*b* is constituted by a PFA tube having a thickness of 50 μm.
- A fixing speed (recording material conveying speed (process speed)): 220 mm/sec
- A distance between the heating device 10 and the pressure device 20: 110 mm
- A total load on the nip portion N1 of the heating device 10: 120 kg
- A width of the nip portion N1 of the heating device 10: 10 mm
- The surface temperatures of the fixing roller 11 and the pressure roller 12 of the fixing device 10: 170° C.
- The surface temperature of the pressure device 20 when the image output is started: 25° C.
- A total load on the nip portion N2 of the pressure device 20 when the image output is started: 140 kg
- The pressure changing means: By the cams 54L and 54R, the pressure roller 22 can be separated away from the fixing roller 21 to change the pressure force of the pressure roller 22 to 80 kg, 100 kg, 120 kg and 140 kg. Specifically, the pressure force of the pressure roller 22 can be controlled in five steps. Among the above-mentioned separated states, 80 kg, 100 kg, 120 kg and 140 kg, the separated state corresponds to the cam faces a of the cams 54L and 54R, 80 kg corresponds to the cam faces b of the cams 54L and 54R, 100 kg corresponds to the cam faces c of the cams 54L and 54R, 120 kg corresponds to the cam faces d of the cams 54L and 54R, and 140 kg corresponds to the cam faces e of the cams 54L and 54R. Peak pressures of the pressure forces are 0 kg/cm$^2$, 4.1 kg/cm$^2$, 4.9 kg/cm$^2$, 5.6 kg/cm$^2$ and 6.2 kg/cm$^2$, respectively.

With respect to the fixing device 9 having the above-mentioned configuration, the recording material P which bears the unfixed toner image ta was introduced into the nip portions N1 and N2 to fix the unfixed toner image ta. As the recording material P, coated paper with a 60-degree gloss of 40 (A4, 170 g/cm$^2$) was used. For the formation of the unfixed toner image ta, a cyan toner, a magenta toner, a yellow toner, and a black toner, each containing a wax, were used. A gradation image was output with a loaded amount of 0.55 mg/cm$^2$ for each color. A glass transition point of the toner used this time was 85° C., and a melting point was 125° C. For a gloss level evaluation, a gloss at 60 degrees was measured with "VG 2000" (fabricated by Nippon Denshoku Industries Co., Ltd.). The graininess was evaluated for black which allows a change in graininess to be perceived in the most remarkable manner.

Here, a method of calculating the graininess will be described.

For the measurement of granularity of silver salt photography, an RMS granularity $\sigma_D$ corresponding to a standard deviation of a density distribution $D_i$ is generally used. The measurement conditions are defined in ANSI PJ-2.40-1985, "root mean square (rms) granularity of film".

$$\sigma_D = \sqrt{\frac{1}{N}\sum_{i=1}^{N}(D_1 \ \overline{D})^2} \qquad \text{(Formula 1)}$$

Moreover, the measurement of the granularity using a Wiener spectrum corresponding to a power spectrum of a density fluctuation has also been proposed. A value obtained by integration after cascading the Wiener spectrum of an image and a visual spatial frequency characteristic (visual transfer function: VTF) is obtained as a graininess (GS). A larger value of the GS indicates a lower graininess.

$$GS=\exp(-1.8\overline{D})\int\sqrt{WS(u)}\cdot VTF(u)du \qquad \text{(Formula 2)}$$

Where, u is a spatial frequency, WS(U) is a Wiener spectrum, and VTF(U) is a visual spatial frequency characteristic. The term exp(−1.8D()) is a function having an average density D() as a variable, for correcting a difference between the density and a brightness perceived by a human (see R. P. Dooley, R. Shaw: "Noise Perception in Electrophotography", J. Appl. Photogr. Eng., 5(4)).

Figure 8:
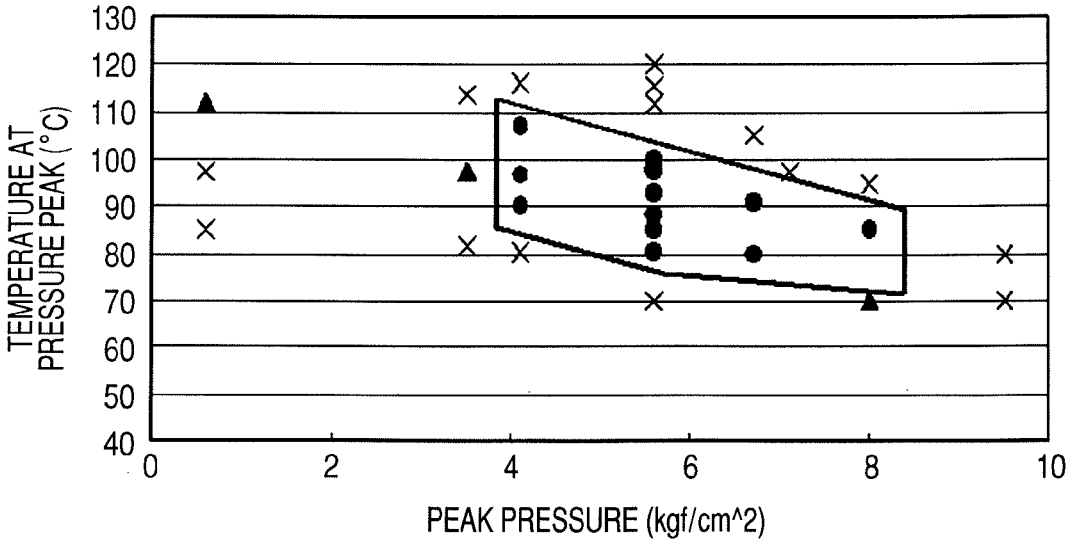
FIG. 8 is a view illustrating a relation among a pressure peak at a nip portion of the image pressure device, a toner temperature when the pressure is at the peak, and image characteristics.

A relation between a pressure peak (peak pressure) at the nip portion N2 of the pressure device 20, a toner temperature when the pressure is at the peak (temperature at the pressure peak), and image characteristics is illustrated in FIG. 8.

Here, the toner temperature was obtained from a temperature profile described below. The measurement of the temperature profile will be described. A K-type thermocouple of 50 μm was caused to pass through the fixing device 9 together with the recording material. A temperature was continuously monitored to obtain the temperature profile with respect to a passage time of the recording material. Since a thermal capacity of the toner is small as compared with that of the recording material, the toner and the recording material reached thermal equilibrium. Since the temperature of the toner is considered to be equal to that of the recording material, the temperature of the toner was obtained from the temperature profile.

In FIG. 8, a black circle indicates a condition where a gloss can be obtained without deteriorating the graininess. A cross indicates a condition where glossing effects were not obtained or the graininess was deteriorated. A black triangle indicates a condition where the glossing effects were obtained without deteriorating the graininess but with a low gloss with respect to that of the recording material.

As a result, it was understood that there is an area of the pressure and temperature which enable a gloss to be obtained in the image containing the halftone without deteriorating the graininess.

Moreover, when the peak pressure at the nip portion N2 must be 8 kg/cm$^2$ or lower because the peak pressure higher than 8 kg/cm$^2$ deteriorates the graininess. If the peak pressure at the nip portion N2 is 7 kg/cm$^2$ or larger, however, a load applied on the fixing roller 21 and the pressure roller 22 of the pressure device 20 becomes too large. As a result, a durability life of each of the fixing roller 21 and the pressure roller 22 is shortened.

Moreover, since an excessively low peak pressure at the nip portion N2 prevents sufficient glossing effects from being obtained, it is desirable that the peak pressure at the nip N2 be equal to or higher than 4 kg/cm$^2$ and equal to or lower than 7 kg/cm$^2$.

First, changes in temperature of the recording material P, the temporarily fixed toner image tb, the fixing roller 21, and the pressure roller 22 when a first image is output will be described.

Figure 9:
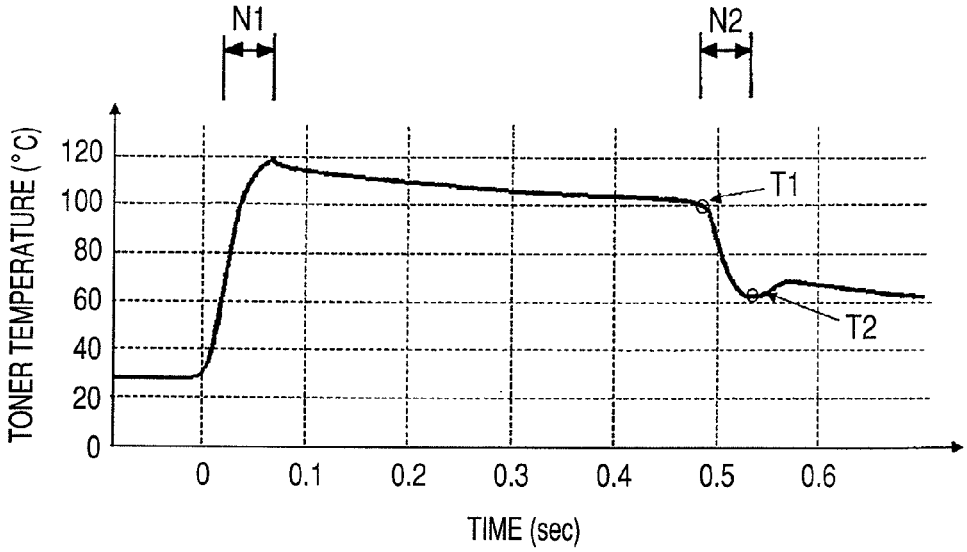
FIG. 9 is a view illustrating an example of a temperature profile when the fixing device of Embodiment 1 is performing a heating/pressurization operation.
Figure 10A:
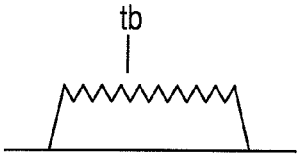
FIG. 10A is a view illustrating a temporarily fixed toner image after being heated by the nip portion of the image heating apparatus.

When the temperature profile was measured under the above-mentioned specific fixing conditions of the fixing device 9, the result as illustrated in FIG. 9 was obtained. The recording material P bearing the unfixed toner image ta is introduced into the nip portion N1 of the heating device 10 to be heated to 120° C. As a result, the unfixed toner image ta is softened and melted. As a result of the softening and melting, the fixability of the unfixed toner image ta to the recording material P is ensured. A surface shape of the toner image reaches a state where its surface shape follows that of the fixing roller 11. When the toner image of the recording material P separates from the surface of the fixing roller 11, however, the toner image now with a high temperature and a lowered viscosity is pulled by the surface of the fixing roller 11. For this reason, the surface shape of the temporarily fixed toner image tb exiting from the nip portion N1 becomes rougher than the state where its surface shape follows that of the fixing roller 11. FIG. 10A illustrates a cross-sectional model of the temporarily fixed toner image tb after being heated by the nip portion N1. FIG. 10A illustrates a state where the surface of the toner image is rough. Thereafter, while the recording material P and the temporarily fixed toner image tb are being conveyed from the heating device 10 to the pressure device 20, the temperatures of the recording material P and the temporarily fixed toner image tb which are heated by the nip portion N1 are lowered by heat radiation.

Figure 10B:
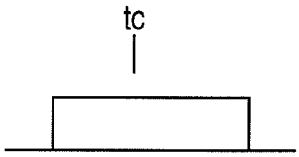
FIG. 10B is a view illustrating a fixed toner image after being pressurized by the nip portion of the image pressure device.

The recording material P bearing the temporarily fixed toner image tb is introduced into the nip portion N2 of the pressure device 20. Since the recording material P and the temporarily fixed toner image tb each having as low a temperature as 25° C. come into contact with the surface of the fixing roller 21 and the surface of the pressure roller 22, the temperatures of the recording material P and the temporarily fixed toner image tb drop more rapidly than a temperature drop due to heat radiation. In this example, a temperature at the start of this rapid temperature drop is defined as a pressurization start time temperature T1. Specifically, the pressurization start time temperature T1 is a temperature of the toner when the pressure means starts pressurizing the unfixed toner image (temporarily fixed toner image tb) heated by the heating means. As a result of determination from the temperature profile illustrated in FIG. 9, T1=100° C. was obtained in this example. Specifically, the temperature T1 of the toner when the pressure means (fixing roller 21 and pressure roller 22) starts pressurizing the unfixed toner image is equal to or higher than a glass transition point of the toner and equal to or lower than a melting point of the toner. The temporarily fixed toner image tb reaches a state where its surface shape follows that of the fixing roller 21 while keeping down the amount of press by the pressurization by the nip portion N2. As a result, the surface of the temporarily fixed toner image becomes a smooth gloss surface. Then, the recording material P and the temporarily fixed toner image tb are discharged from the nip portion N2 in a state cooled by the nip portion N2. Though the temperatures of the recording material P and the fixed toner image tc are slightly elevated by heat accumulated in the recording material P after the discharge, the temperatures then start dropping again by heat radiation. In this example, a temperature obtained when the temperature drops to its lowest value in the nip portion N2 is defined as a pressurization end time temperature T2. Specifically, the pressurization end time temperature T2 is a temperature of the toner when the pressure means terminates the pressurization on the temporarily fixed toner image tb. As a result of determination from the temperature profile illustrated in FIG. 9, T2=62° C. was obtained in this example. Specifically, the temperature T2 of the toner when the pressure means (fixing roller 21 and pressure roller 22) terminates the pressurization on the unfixed toner image (temporarily fixed toner image tb) heated by the heating means is equal to or lower than the glass transition point of the toner. The viscosity of the toner image tc is high when the toner image is discharged from the pressure device 20. Therefore, the surface shape of the toner image tc does not become rough again by the toner image tc pulled by the surface of the fixing roller 21. As a result, a highly gloss image with good graininess and a smooth surface is formed. FIG. 10B illustrates a cross-sectional model of the toner image tc after being pressurized by the nip portion N2. As described above, in the fixing device of this example, during a time period in which the toner image passes through the second nip portion N2, the temperature of the toner image on the recording material drops from the temperature T1 higher than the glass transition point of the toner to the temperature T2 lower than the glass transition point.

Moreover, in a process in which the recording material P is being introduced to the nip portion N2, heat is exchanged between the fixing roller 21 and the pressure roller 22, the recording material P, and the temporarily fixed toner image tb. As a result, the surface temperature of the fixing roller 21 was elevated from 25° C. before the introduction to 37° C. after the discharge.

Figure 11:
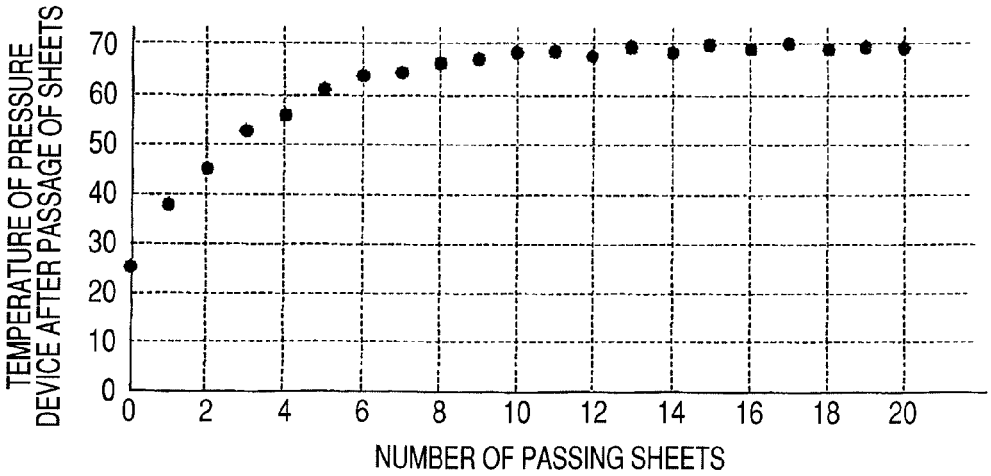
FIG. 11 is a view illustrating a relation between the number of the recording materials introduced into the nip portion of the image pressure device and a temperature of the image pressure device after the recording materials are introduced.

As described above, each time the recording material P and the temporarily fixed toner image tb, which are heated by the nip portion N1 of the heating device 10, pass through the nip portion N2 of the pressure device 20, the temperature of the fixing roller 21 continues increasing. After the passage of the tenth recording material and temporarily fixed image, the temperature of the fixing roller 21 is saturated at 70° C. (FIG. 11). FIG. 11 is a view illustrating a relation between the number of introduced recording materials (number of passing sheets) to the nip portion N2 of the pressure device 20 and the temperature of the pressure device 20 (temperature of the fixing roller 21) after the introduction of the recording material (after the passage of the sheet).

While the fixing device 9 is in the standby state and is performing the heating/pressurization operation, the pressurization control section 53 constantly monitors a change in temperature of the fixing roller 21 by a signal from the thermistor 51 and a change in temperature of the pressure roller 22 by a signal from the thermistor 52. Then, the pressurization control section 53 determines an optimal pressure force of the pressure roller 22 based on the result of detection of the temperatures of the fixing roller 21 and the pressure roller 22 by the thermistors 51 and 52 and the table stored in the memory for each recording material. Then, the pressurization control section 53 controls the rotations of the cams 54L and 54R to change the pressure force of the pressure roller 22 to an optimal pressure force.

Figure 12:
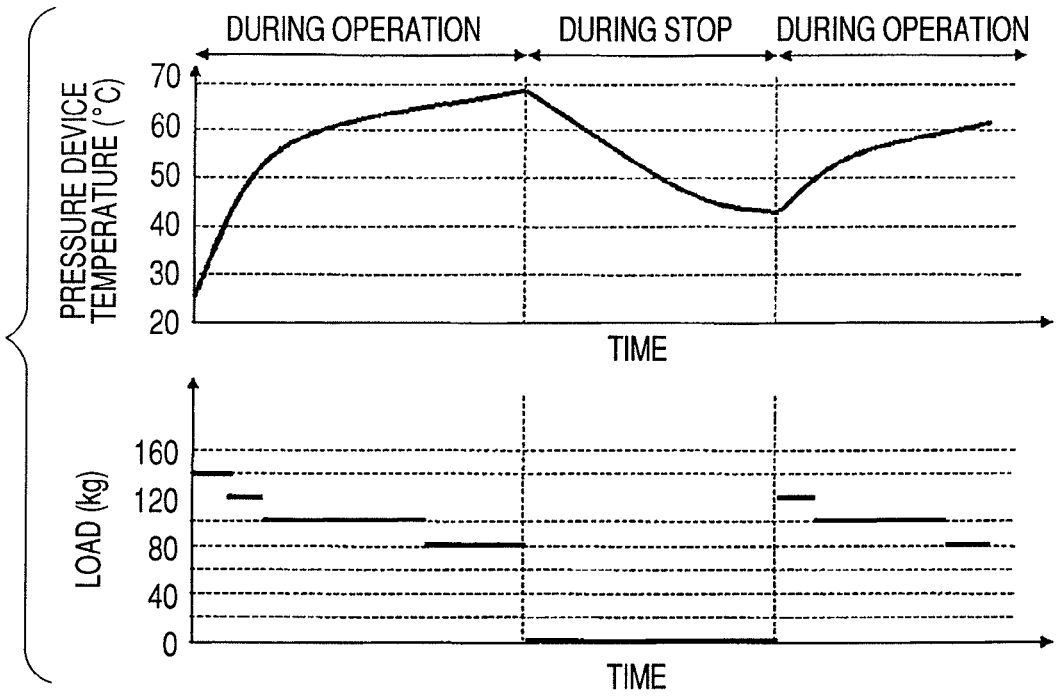
FIG. 12 is a view illustrating a relation between a surface temperature of a fixing roller of the image pressure device and a total load on the nip portion.
Figure 13:
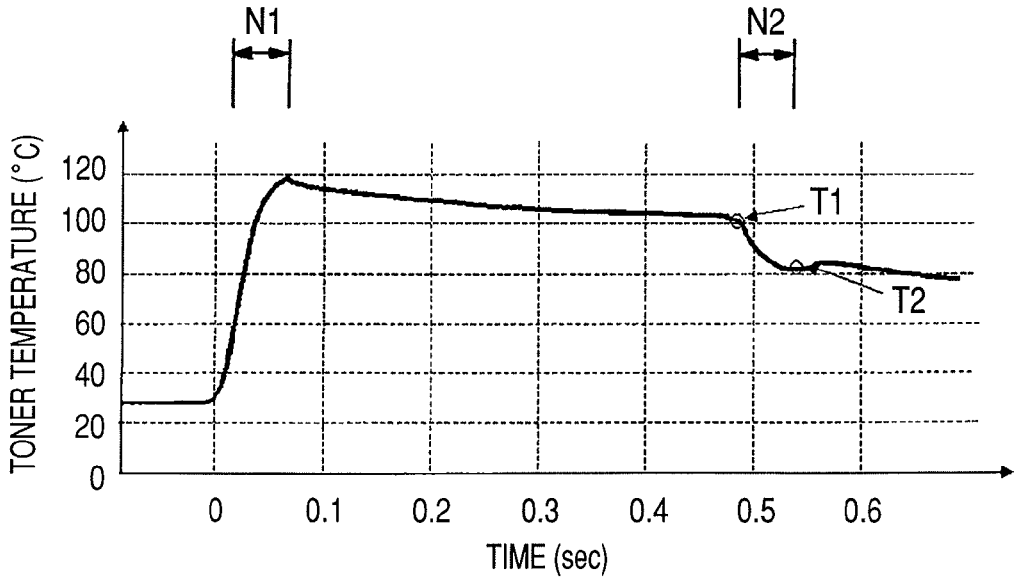
FIG. 13 is a view illustrating an example of a temperature profile when a temperature of the fixing roller of the image pressure device is elevated when the fixing device of Embodiment 1 performs the heating/pressurization operation.

A relation between the surface temperature of the fixing roller 21 and a total load (load) on the nip portion N2 is illustrated in FIG. 12. In FIG. 12, the surface temperature of the fixing roller 21 is referred to as a pressure device temperature, whereas the total load on the nip portion N2 is referred to as a load. FIG. 13 illustrates a temperature profile when the temperature of the fixing roller 21 is elevated to 70° C.

When the temperature of the fixing roller 21 is elevated while the fixing device 9 is in operation for performing the heating/pressurization operation, the temporarily fixed toner image tb is less easily cooled as illustrated in FIG. 13 to cause the temporarily fixed toner image tb to maintain a low viscosity state. Therefore, when the same pressure as that when the temperature of the fixing roller 21 is 25° C., at which the temporarily fixed toner image tb is sufficiently cooled, is applied to the pressure roller 22, the fixing roller 21 not only smoothens the surface of the temporarily fixed toner image tb but also presses the entire toner image 2. In order to prevent the press, the pressurization control section 53 controls the rotations of the cams 54L and 54R based on the temperatures of the fixing roller 21 and the pressure roller 22 which are detected by the thermistors 51 and 52 to operate the pressure roller 22 so as to reduce the total load on the nip portion N2. Specifically, the pressurization control section 53 operates the pressure roller 22 so as to reduce the pressure force of the pressure roller 22. As a result, the pressure force of the pressure roller 22 is changed to an appropriate pressure force. As described above, in the fixing device of this example, the control section 53 controls the pressure force changing sections (cams 54L and 54R) so as to reduce the pressure force applied to the second nip portion N2 as the temperatures detected by the temperature detecting sections 51 and 52 become higher.

Moreover, when the fixing roller 21 and the pressure roller 22 are in contact with each other while the fixing device 9 is stopped in the standby state, the durability life of each of the fixing roller 21 and the pressure roller 22 is shortened. Therefore, when the fixing device 9 is in the standby state with no output of the image, the pressurization control section 53 controls the rotations of the cams 54L and 54R to separate the fixing roller 21 and the pressure roller 22 from each other to operate the pressure roller 22 so as to allow the total load on the nip portion N2 to be 0 (zero). Then, the pressurization control section 53 controls the rotations of the cams 54L and 54R based on the temperatures of the fixing roller 21 and the pressure roller 22 which are detected by the thermistors 51 and 52 to operate the pressure roller 22 so as to increase the total load on the nip portion N2 immediately before the restart of the image output. As a result, the pressure force of the pressure roller 22 is set to an appropriate pressure force.

Figure 14:
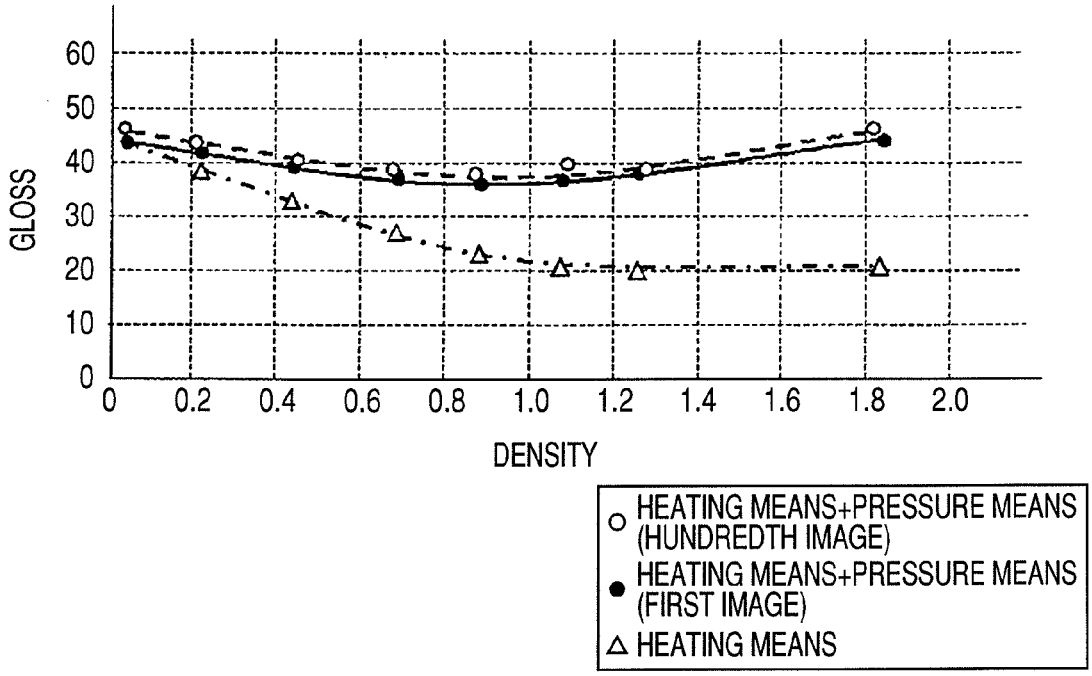
FIG. 14 is an explanatory view (1) illustrating effects of the fixing device of Embodiment 1.
Figure 15:
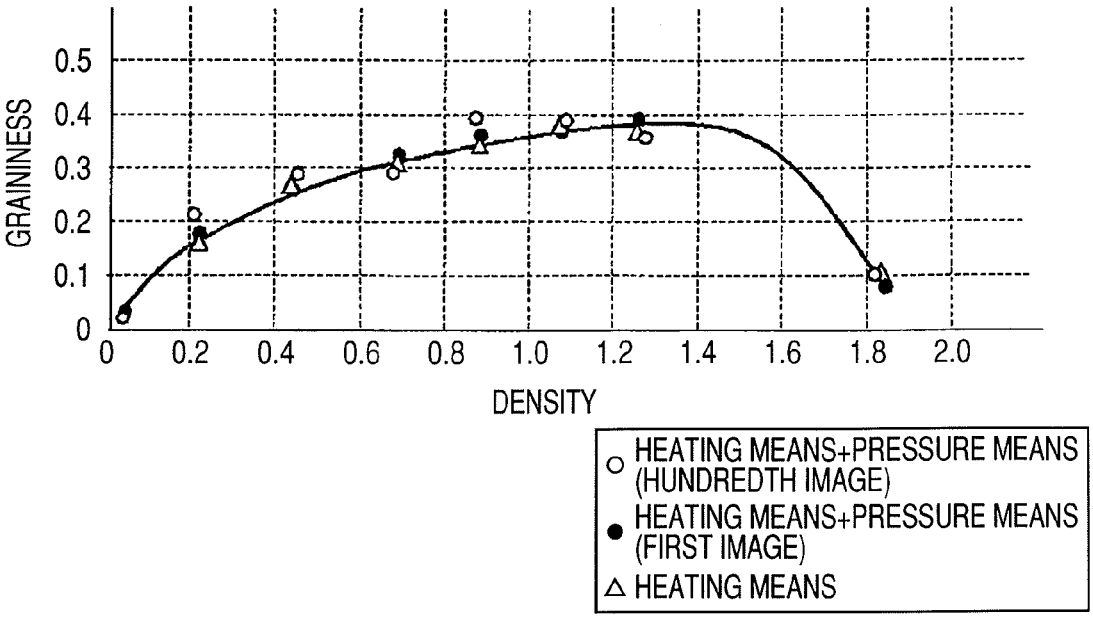
FIG. 15 is an explanatory view (2) illustrating effects of the fixing device of Embodiment 1.

For examining the effects of the fixing device 9 of this example, FIG. 14 illustrates glosses of an image obtained after the passage through the heating device 10 alone and the first image and the hundredth image when one hundred images are caused to pass through the heating device 10 and the pressure device 20, with respect to a density. FIG. 15 illustrates the graininess of the image with respect to the density.

The pressure force of the pressure roller 22 is changed according to the temperatures of the fixing roller 21 and the pressure roller 22 which are detected by the thermistors 51 and 52. As a result, even when the images were continuously output, only the surface of the temporarily fixed toner image tb was successfully smoothed without pressing the entire temporarily fixed toner image tb. As a result, an image with a high gloss equal to that of the recording material P was successfully output without image deterioration such as a difference in gloss between the images when the images are continuously output, the deterioration of graininess of the image containing the halftone, the thickening or blur of the thin line, and the degradation of visibility of the small point size character. Specifically, by preventing the toner of each pixel from being pressed, a difference in area between the pixels is suppressed to prevent the degradation of the graininess.

Comparative Example 1

As Comparative Example 1, a fixing device having the following configuration is given. The fixing device of Comparative Example 1 has the same configuration as that of the fixing device 9 of this example. However, the pressure roller 22 is not operated even when the temperatures of the fixing roller 21 and the pressure roller 22 change, and the pressure force is fixed to make the total load on the nip portion N2 be 140 kg, which is optimal when the temperatures of the fixing roller 21 and the pressure roller 22 are 25° C. For comparison with the fixing device 9 of this example, one hundred images were continuously output under the same conditions as those for the fixing device 9 of this example.

Figure 16:
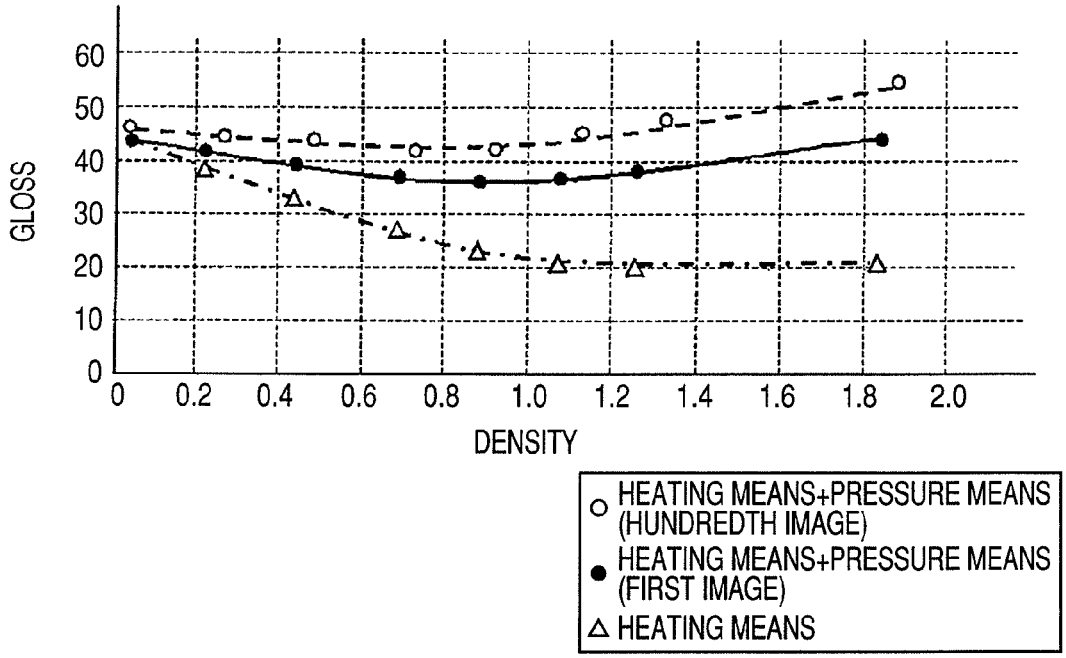
FIG. 16 is an explanatory view (1) illustrating effects of the fixing device of Comparative Example 1.
Figure 17:
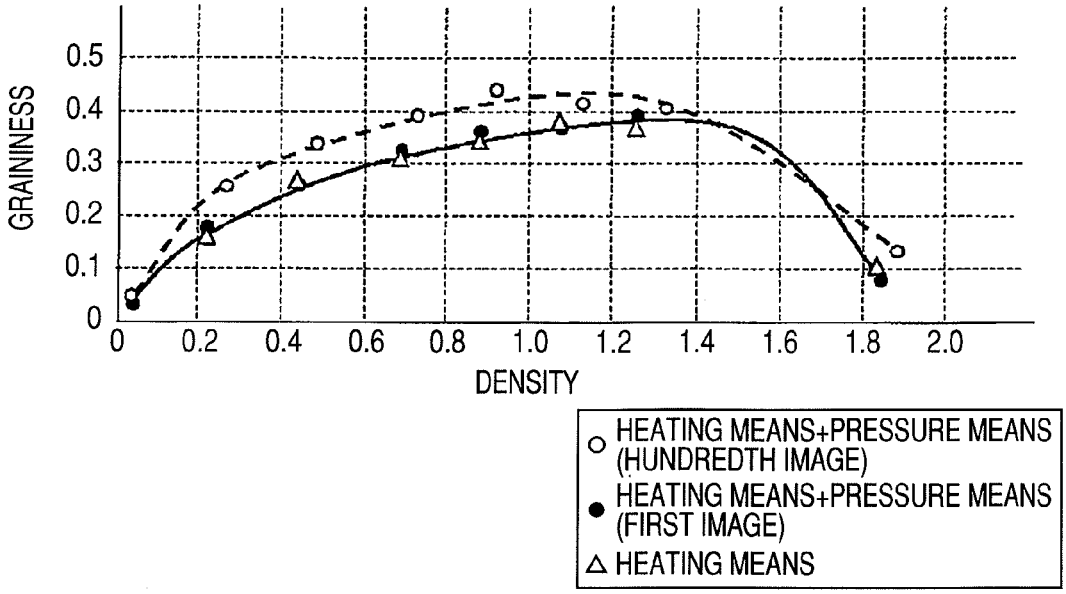
FIG. 17 is an explanatory view (2) illustrating effects of the fixing device of Comparative Example 1.

For examining the effects of the fixing device of Comparative Example 1, FIG. 16 illustrates glosses of an image obtained after the passage of the recording material through the heating device 10 alone and the first image and the hundredth image when one hundred images are caused to pass through the heating device 10 and the pressure device 20, with respect to a density. FIG. 17 illustrates the graininess of the image with respect to the density.

Figure 10C:
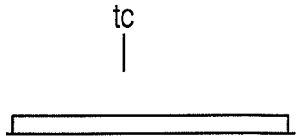
FIG. 10C is a view illustrating a temporarily fixed toner image after being pressed by the nip portion of the image pressure device.

In the fixing device of Comparative Example 1, the temperatures of the fixing roller 21 and the pressure roller 22 continue increasing by continuously outputting the images as in the case of the fixing device 9 of this example. However, in order to give a gloss when the temperatures of the fixing roller 21 and the pressure roller 22 are as low as 25° C., the load is fixed to be higher, i.e., 140 kg. As a result, when the recording materials are caused to continuously pass, the temperature of the temporarily fixed toner image tb is not sufficiently lowered in the nip portion N2 of the pressure device 20 as the temperatures of the fixing roller 21 and the pressure roller 22 are elevated. Therefore, the temporarily fixed toner image tb is gradually pressed by the nip portion N2 of the pressure device 20. FIG. 10C illustrates a cross-sectional model of the temporarily fixed toner image tc pressed by the nip portion N2. The model illustrated in FIG. 10C illustrates that the area becomes too large due to the excessively pressed toner. If the toner of each pixel is excessively pressed as described above, a difference in amount (volume) of toner for each pixel appears as a difference in area, thereby deteriorating the graininess. Moreover, as illustrated in FIG. 16, a difference in gloss between the first image and the hundredth image becomes larger. Further, on the hundredth image with which the temperature of the fixing roller 21 reaches 70° C. corresponding to a saturation temperature, the deterioration of graininess of the image containing the halftone (FIG. 17), the thickening and blur of the thin line, and the degradation of visibility of the small point size character are adversely brought about.

Comparative Example 2

As Comparative Example 2, a fixing device having the following configuration is given. The fixing device of Comparative Example 2 also has the same configuration as that of the fixing device 9 of this example. However, the pressure roller 22 is not operated even when the temperatures of the fixing roller 21 and the pressure roller 22 change, and the total load on the nip portion N2 is fixed to be 80 kg, which is optimal when the temperature of the fixing roller 21 reaches 70° C. corresponding to the saturation temperature. For comparison with the fixing device 9 of this example, one hundred images were continuously output under the same conditions as those for the fixing device 9 of this example.

Figure 18:
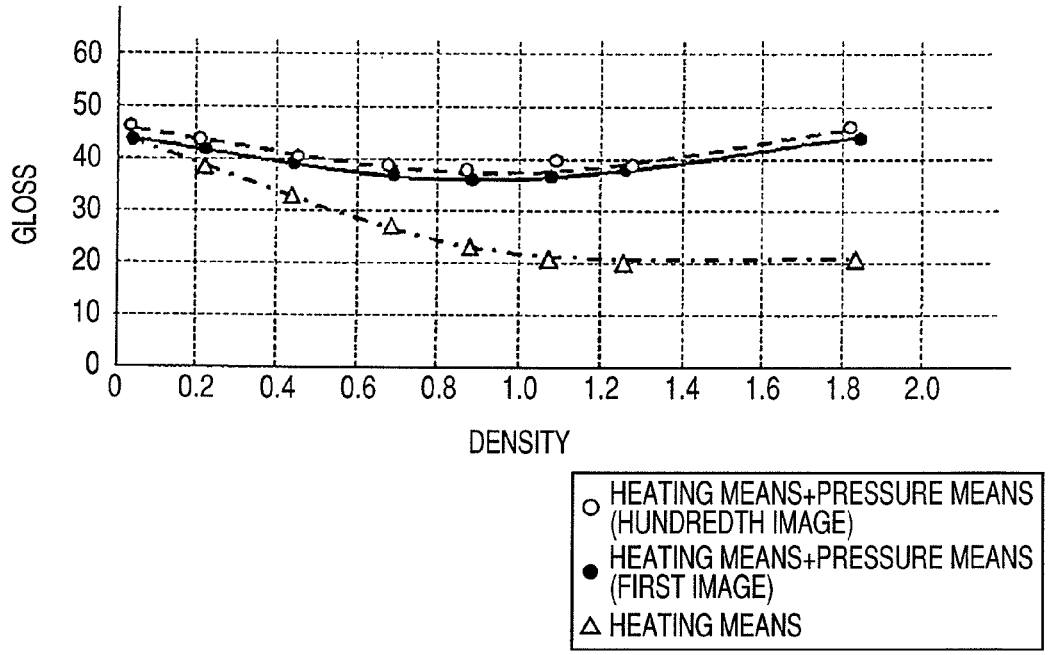
FIG. 18 is an explanatory view (1) illustrating effects of the fixing device of Comparative Example 2.
Figure 19:
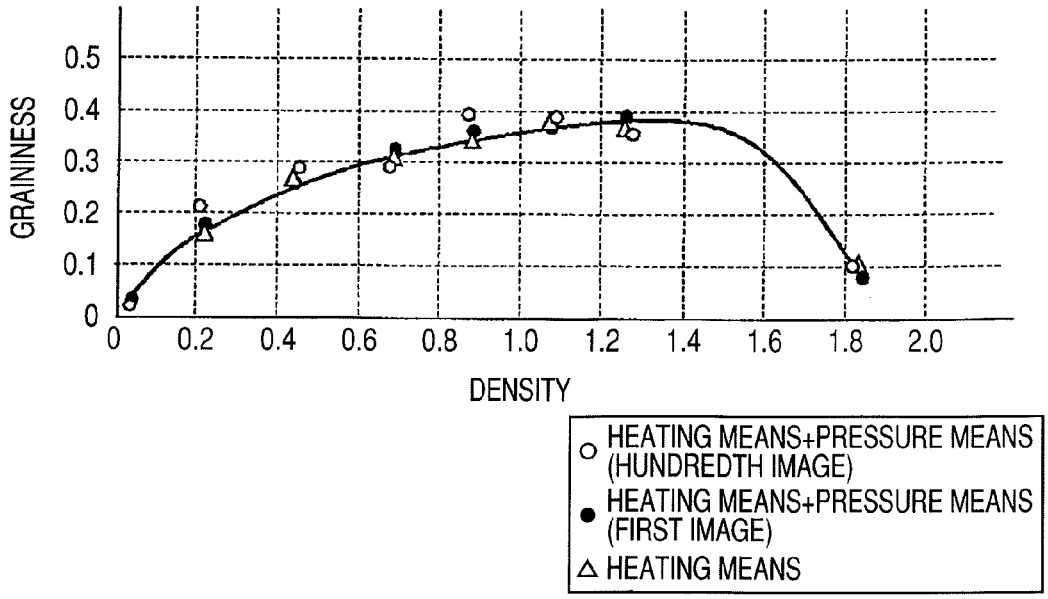
FIG. 19 is an explanatory view (2) illustrating effects of the fixing device of Comparative Example 2.

For examining the effects of the fixing device of Comparative Example 2, FIG. 18 illustrates glosses of an image obtained after the passage of the recording material through the heating device 10 alone and the first image and the hundredth image when one hundred recording materials are caused to continuously pass through the heating device 10 and the pressure device 20, with respect to a density. FIG. 19 illustrates the graininess of the image with respect to the density.

In the fixing device of Comparative Example 2, too, the temperatures of the fixing roller 21 and the pressure roller 22 continue increasing by continuously outputting the images as in the case of the fixing device 9 of this example. However, when the temperature of the fixing roller 21 is close to 70° C. corresponding to the saturation temperature, the load is fixed to be as low as 80 kg in order to give a gloss without pressing the temporarily fixed toner image tb. Therefore, when the recording materials are allowed to continuously pass, the temporarily fixed toner image tb is not gradually pressed in the nip portion N2 of the pressure device 20 as the temperatures of the fixing roller 21 and the pressure roller 22 are elevated. Thus, the graininess does not degrade (FIG. 19). However, since the pressure is too low for the temporarily fixed toner image tb on the first output image when the recording materials are caused to continuously pass, the glossing effects by the pressure force of the nip portion N2 cannot be sufficiently obtained. Therefore, a large difference is generated in gloss with the hundredth image which is output when the temperature of the fixing roller 21 is in the vicinity of 70° C. corresponding to the saturation temperature (FIG. 18).

Table 1 illustrates the difference in gloss between the first image and the hundredth image and the evaluation of graininess of the temporarily fixed toner image in each of the fixing devices of this example, Comparative Example 1, and Comparative Example 2 described above.

TABLE 1

| | Embodiment 1 | | Comparative Example 1 | | Comparative Example 2 | |
|---|---|---|---|---|---|---|
| | First image | Hundredth image | First image | Hundredth image | First image | Hundredth image |
| Difference in gloss between first image and hundredth image | GOOD | | FAIL | | FAIL | |
| Graininess | GOOD | GOOD | GOOD | FAIL | GOOD | GOOD |

As is apparent from Table 1, the fixing device of this example has a small difference in gloss when the first image is printed and when multiple images are printed in the case of continuous printing as compared with the fixing devices of Comparative Example 1 and Comparative Example 2, and the deterioration of graininess is suppressed.

Embodiment 2

Next, Embodiment 2 of the present invention is described. The fixing device of this example includes a heating section for heating the recording material in a noncontact state between the first nip portion forming unit and the second nip portion forming unit. Then, the heating section heats the toner image on the recording material so as to cause the temperature of the toner image when the toner image enters the second nip portion to be higher than the temperature of the toner image when the heating is terminated in the first nip portion. As a result, the fixing device providing a gloss further superior to that of the fixing device of Example 1 while suppressing the deterioration of graininess is provided.

Figure 20:
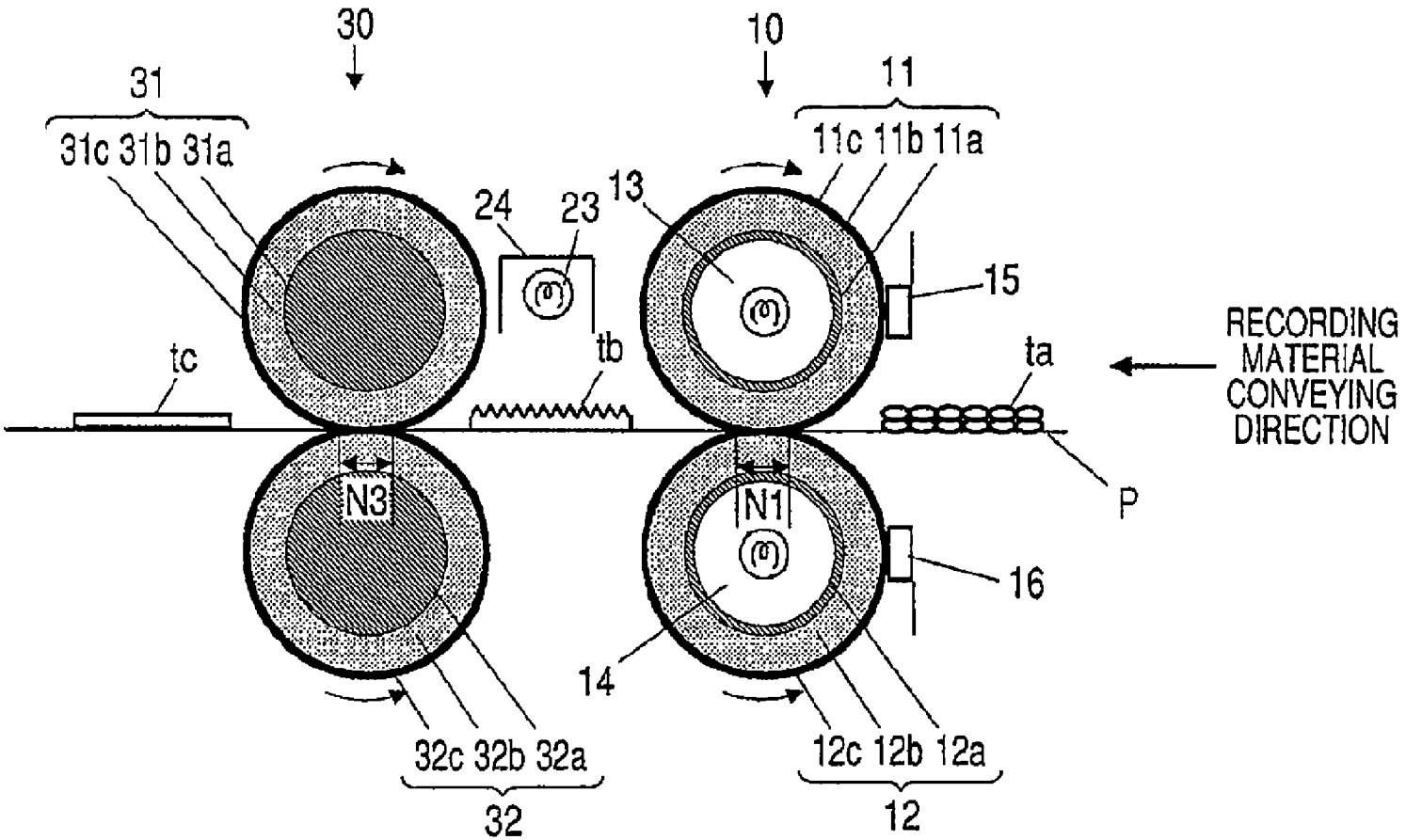
FIG. 20 is a schematic horizontal cross-sectional view of the fixing device of Embodiment 2.

In the fixing device 9 illustrated in FIG. 20, the specific configurations of the heating/pressure device (first nip portion forming unit) 10, the noncontact heating device (heating section) 24, and a pressure device (second nip portion forming unit) 30 are as follows.

The fixing roller 11 of the heating/pressure device 10 and a fixing roller 31 of the pressure device 30: A diameter is 60 mm and a length is 330 mm. As a material of cored bars 11*a* and 31*a*, aluminum is used. The cored bar is coated with a silicone rubber to a thickness of 2.5 mm as each of elastic layers 11*b* and 31*b*. Each of release layers 11*c* and 31*c* respectively on the elastic layers 11*b* and 31*b* is constituted by a PFA tube having a thickness of 50 μm.

The pressure roller 12 of the heating/pressure device 10 and a pressure roller 32 of the pressure device 30: A diameter is 60 mm and a length is 330 mm. As a material of cored bars 12*a* and 32*a*, aluminum is used. The cored bar is coated with a silicone rubber to a thickness of 1.5 mm as each of elastic layers 12*b* and 32*b*. Each of release layers 12*c* and 32*c* respectively on the elastic layers 12*b* and 32*b* is constituted by a PFA tube having a thickness of 50 μm.

The noncontact heating device 24: A halogen heater 23 having a length of 340 mm is used.

A fixing speed (recording material conveying speed (process speed)): 220 mm/sec

A distance between the heating/pressure device 10 and the noncontact heating device 24: 30 mm A distance between the noncontact heating device 24 and the pressure device 30: 10 mm A total load on the nip portion N1 of the heating/pressure device 10: 120 kg A peak of the pressure force of the heating/pressure device 10: 5.6 kg/cm$^2$ A width of the nip portion N1 of the heating/pressure device 10: 10 mm The surface temperatures of the fixing roller 11 and the pressure roller 12 of the heating/pressure device 10: 160° C.

1A total load on the nip portion N1 of the heating device 10 when the image output is started: 120 kg The surface temperature of the pressure device 30: 25° C.

A total load on a nip portion N3 of the pressure device 30: 140 kg

A peak of the pressure force of the pressure device 30: 6.2 kg/cm$^2$

A width of the nip portion N3 of the pressure device 30: 12 mm

For the fixing device 9 having the above-mentioned configuration, the recording material P which bears the unfixed toner image ta was introduced into the nip portions N1 and N3 to fix the unfixed toner image ta.

As the recording material P, coated paper with a 60-degree gloss of 40 (A4, 170 g/cm$^2$) was used. For the formation of the unfixed toner image ta, a cyan toner, a magenta toner, a yellow toner and a black toner, each containing a wax, were used. A gradation image was output with a loaded amount of 0.55 mg/cm$^2$ for each color. A glass transition point of the toner used this time was 85° C., and a melting point was 125° C. For a gloss level evaluation, a gloss at 60 degrees was measured with "VG 2000" (fabricated by Nippon Denshoku Co., Ltd.). The graininess was evaluated with black which allows a change in graininess to be perceived in the most remarkable manner.

Figure 21:
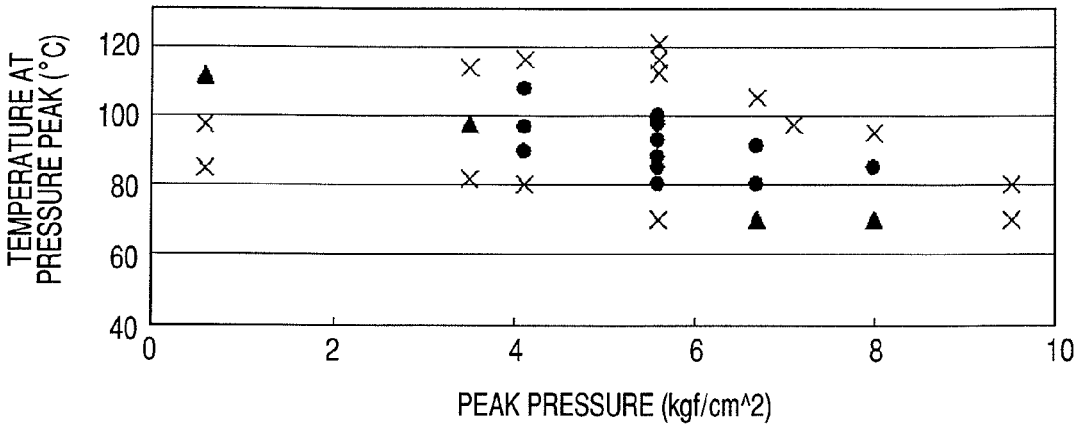
FIG. 21 is a view illustrating a relation among the pressure peak at the nip portion of the image pressure device, the toner temperature when the pressure is at the peak, and the image characteristics.

A relation among a pressure peak (peak pressure) at the nip portion N3 of the pressure device 30, a toner temperature when the pressure is at the peak (temperature at pressure peak), and image characteristics is illustrated in FIG. 21.

In FIG. 21, a black circle indicates a condition under which a gloss can be obtained without deteriorating the graininess. A cross indicates a condition under which glossing effects were not obtained or the graininess was deteriorated. A black triangle indicates a condition under which the glossing effects were obtained without deteriorating the graininess but with a low gloss with respect to that of the recording material.

As a result, it is understood that there is an area of the pressure and the temperature which enable a gloss to be obtained in the image containing the halftone without deteriorating the graininess.

Moreover, the peak pressure at the nip portion (second nip portion) N3 must be 8 kg/cm$^2$ or lower because the peak pressure higher than 8 kg/cm$^2$ or higher deteriorates the graininess. If the peak pressure at the nip portion N3 is 7 kg/cm$^2$ or higher, however, a load applied on the fixing roller 21 and the pressure roller 22 of the pressure device 20 becomes too large. As a result, a durability life of each of the fixing roller 21 and the pressure roller 22 is shortened.

Moreover, since an excessively low peak pressure at the nip portion N3 prevents sufficient glossing effects from being obtained, the peak pressure at the nip N3 can be equal to or higher than 4 kg/cm$^2$ and equal to or lower than 7 kg/cm$^2$.

First, changes in temperature of the recording material P, the unfixed toner image ta, and the temporarily fixed toner image tb when an image is output are described.

Figure 22:
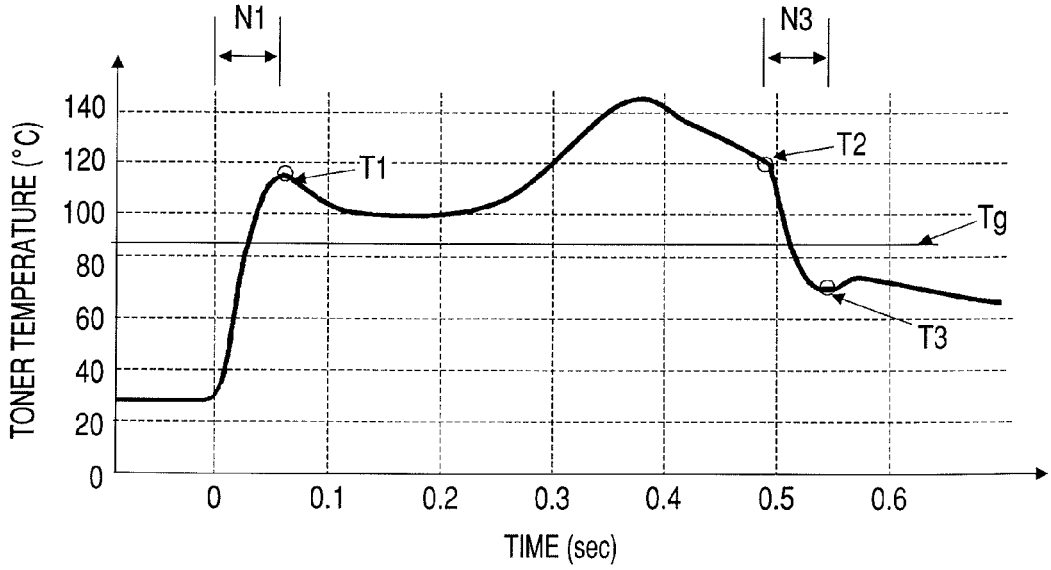
FIG. 22 is a view illustrating an example of a temperature profile when the fixing device of Embodiment 2 performs the heating/pressurization operation.

When the temperature profile was measured under the above-mentioned specific fixing conditions of the fixing device 9, the result as illustrated in FIG. 22 was obtained. The recording material P bearing the unfixed toner image ta is introduced into the nip portion (first nip portion) N1 of the heating/pressure device 10 to be heated. As a result, the unfixed toner image ta is softened and melted. Further, as a result of heating and pressurizing, the fixability of the toner image to the recording material P is ensured. Color mixture of a toner in a secondary color portion and a tertiary color portion is also performed. A surface shape of the toner image reaches a state in which its surface shape follows that of the fixing roller 11. When the toner image on the recording material P separates from the surface of the fixing roller 11, however, the toner image is pulled by the surface of the fixing roller 11. For this reason, the surface shape of the temporarily fixed toner image tb exiting from the nip portion N1 becomes rougher than the state in which its surface shape follows that of the fixing roller 11 (FIG. 5 (23*a*)). Thereafter, while the recording material P and the temporarily fixed toner image tb are being conveyed from the heating/pressure device 10 to the pressure device 30, the temperatures of the recording material P and the temporarily fixed toner image tb which are heated by the nip portion N1 are lowered by heat radiation. In this example, a temperature at the start of this temperature drop is defined as a heating/pressurization end time temperature T1. Specifically, the heating/pressurization end time temperature T1 is a temperature of the toner when the heating/pressure means 10 terminates heating and pressurizing the unfixed toner image ta. As a result of determination from the temperature profile illustrated in FIGS. 23A, 23B, 23C, 23D and 23E, T1=115° C. was obtained in this example. Specifically, the temperature T1 of the toner when the heating/pressure means (fixing roller 11 and pressure roller 12) terminates pressurizing the unfixed toner image ta is equal to or higher than the glass transition point of the toner. As a result, the unfixed toner image ta is temporarily fixed without being pressed by the heating/pressure device 10.

As the recording material P and the temporarily fixed toner image tb approach the noncontact heating device 24, the recording material P and the temporarily fixed toner image tb are heated by heat rays from the noncontact heating device 24 to elevate the temperatures of the recording material P and the temporarily fixed toner image. When the recording material P and the temporarily fixed toner image tb pass immediately below the noncontact heating device 24, the temperatures are elevated to 142° C. After the recording material P and the temporarily fixed toner image tb pass immediately below the noncontact heating device 24, the temperatures of the recording material P and the temporarily fixed toner image tb drop due to heat radiation.

Figure 23A:
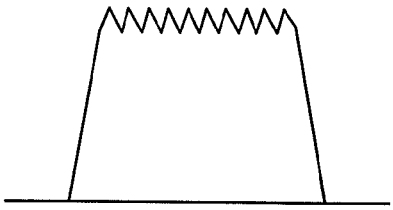
FIG. 23A is a view illustrating the temporarily fixed toner image after being heated and pressurized by the nip portion of a heating/pressure device.
Figure 23B:
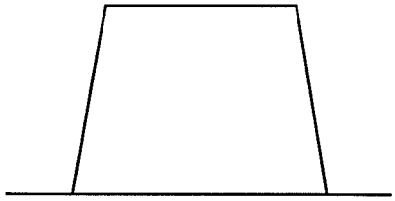
FIG. 23B is a view illustrating the fixed toner image after being pressurized by the nip portion of the pressure device.

The recording material P bearing the temporarily fixed toner image tb is introduced into the nip portion N3 of the pressure device 30. Since the recording material P and the temporarily fixed toner image tb come into contact with the surface of the fixing roller 31 and the surface of the pressure roller 32 at a temperature as low as 25° C., the temperatures of the recording material P and the temporarily fixed toner image tb drop more rapidly than a temperature drop due to heat radiation. In this example, a temperature at the start of this rapid temperature drop is defined as a pressurization start time temperature T2. Specifically, the pressurization start time temperature T2 is a temperature of the toner when the pressure means starts pressurizing the temporarily fixed toner image tb. As a result of determination from the temperature profile illustrated in FIG. 22, T2=200° C. was obtained in this example. Specifically, the temperature T2 of the toner when the pressure means (fixing roller 31 and the pressure roller 32) starts pressurizing the toner image is equal to or higher than the glass transition point of the toner. The recording material P and the temporarily fixed toner image tb are pressurized by the nip portion N3. As a result, the surface of the temporarily fixed toner image tb reaches a state in which its surface follows that of the fixing roller 31, resulting in a smooth gloss surface of the toner image. The recording material P and the temporarily fixed toner image tb are started to be pressurized in the nip portion N3 at a temperature higher than the temperature T1 at the end of the pressurization in the heating/pressure device 10. However, the recording material P and the temporarily fixed toner image tb are rapidly cooled by the pressure device 30 simultaneously with the pressurization, thereby solidifying the temporarily fixed toner image tb. As a result, the toner image is discharged from the nip portion N3 without being pressed. After the discharge, the temperatures of the recording material P and the fixed toner image tc are slightly elevated by the heat accumulated in the recording material P. Thereafter, however, the temperatures start dropping again by heat radiation. In this example, the lowest temperature in the nip portion N3 is defined as a pressurization end time temperature T3. Specifically, the pressurization end time temperature T3 is a temperature of the toner when the pressure means terminates the pressurization on the temporarily fixed toner image tb. As a result of determination from the temperature profile illustrated in FIG. 22, T3=73° C. was obtained in this example. Specifically, the temperature T3 of the toner when the pressure means (fixing roller 31 and pressure roller 32) terminates the pressurization on the temporarily fixed toner image tb is equal to or lower than the glass transition point of the toner. The toner image tc is discharged from the pressure device 30 in a high viscosity state. Therefore, the surface shape of the toner image tc is not roughened again by the toner image tc pulled by the surface of the fixing roller 31. Therefore, the toner image having a smooth surface following the surface of the fixing roller 31 is formed (FIG. 23B). As a result, a highly gloss image having a smooth surface with good graininess is formed.

Figure 24:
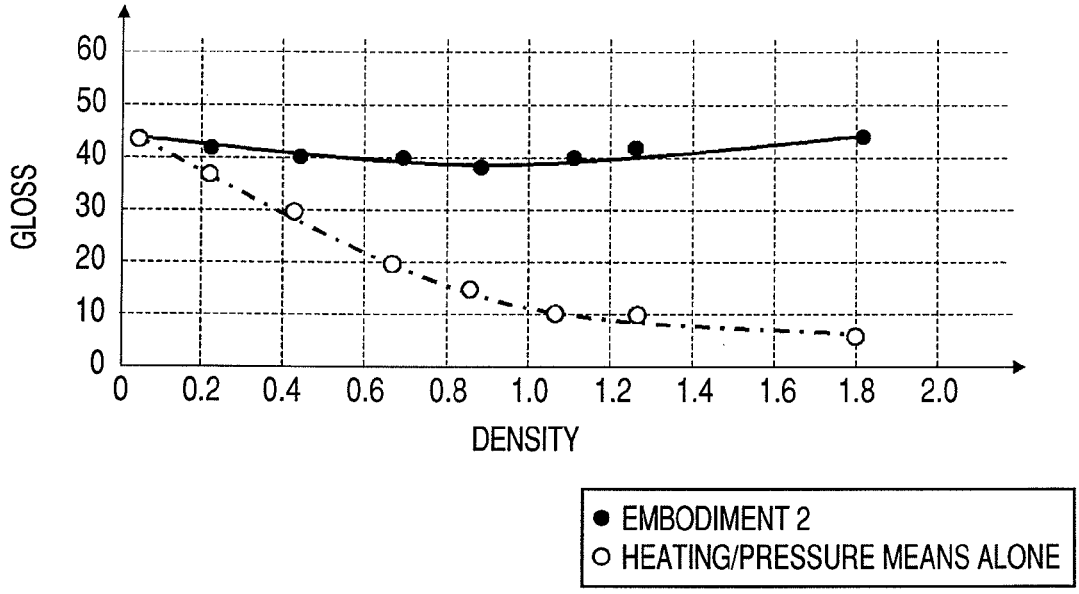
FIG. 24 is an explanatory view (1) illustrating effects of the fixing device of Embodiment 2.
Figure 25:
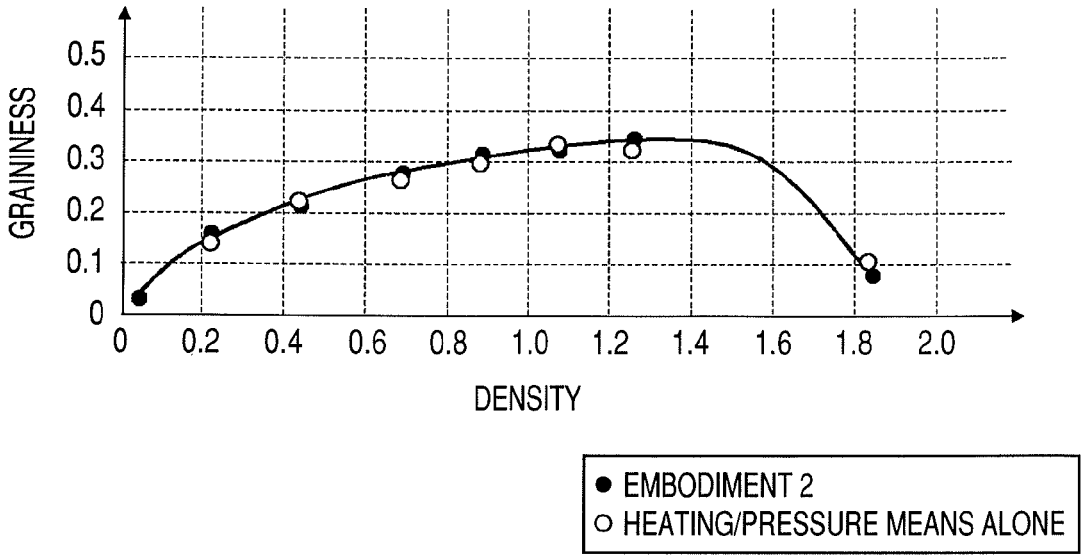
FIG. 25 is an explanatory view (2) illustrating effects of the fixing device of Embodiment 2.

For examining the effects of the fixing device 9 of this example, FIG. 24 illustrates a gloss level (gloss) of the image passing through the heating/pressure device 10 alone, and that of the image, which is heated by the noncontact heating device 24 after passing through the heating/pressure device 10 to then pass through the pressure device 30, with respect to the density. The image passing through the fixing device of this example is obtained as a more highly gloss image as compared with the image passing through the heating/pressure device 10 alone. FIG. 25 illustrates the graininess of each of the images with respect to the density. The image passing through the fixing device of this example exhibits the graininess equal to that of the image passing through the heating/pressure device 10 alone. Specifically, it is understood that the toner image is pressurized by the pressure device 30 without deteriorating the graininess. In this example, the entire area of the surface of the temporarily fixed toner image tb could be smoothed without excessively pressing the entire temporarily fixed toner image tb. As a result, the image with a high gloss equal to that of the recording material P was successfully output without causing the image deterioration such as the deterioration of graininess of the image containing a halftone, the thickening and blur of the thin line, and the degradation of visibility of the small point size character.

Comparative Example 3

As Comparative Example 3 for Embodiment 2, a fixing device having the following configuration is given. The fixing device of Comparative Example 3 has the same configuration as that of the fixing device 9 of this example. However, the image was output without operating the heater (halogen heater) 23 of the noncontact heating device 24. At this time, T1=115° C., T2=90° C., and T3=55° C. were obtained.

Figure 23C:
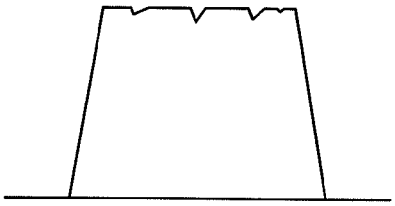
FIG. 23C illustrates the fixed toner image pressed by the fixing device of Comparative Example 3.
Figure 26:
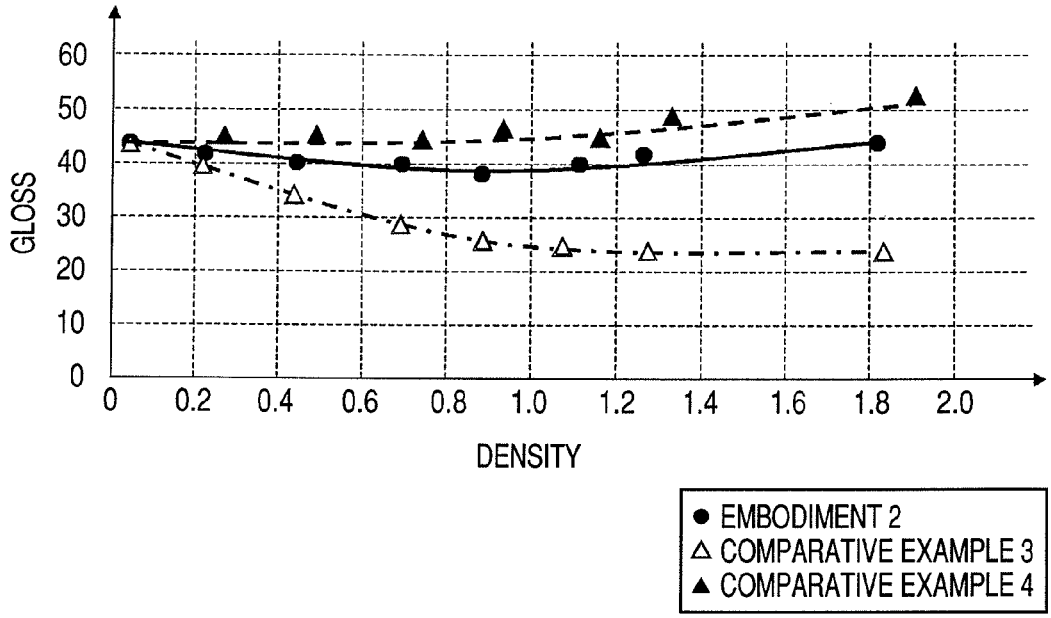
FIG. 26 is an explanatory view (1) illustrating differences in effects of the fixing devices of Embodiment 2, Comparative Example 3, and Comparative Example 4.
Figure 27:
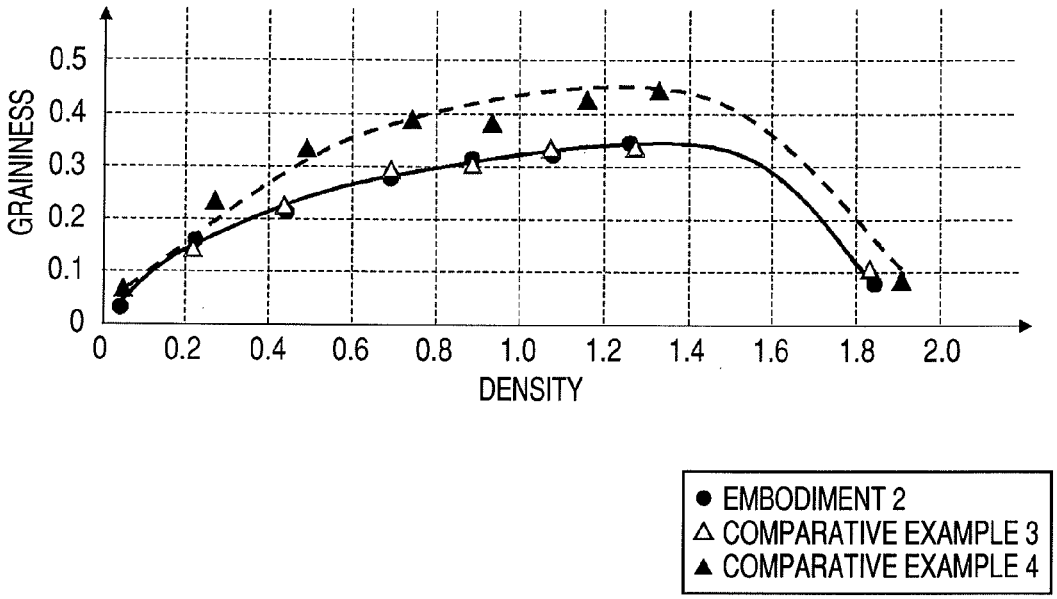
FIG. 27 is an explanatory view (2) illustrating differences in effects of the fixing devices of Embodiment 2, Comparative Example 3, and Comparative Example 4.

For comparison of the effects between the fixing device 9 of this embodiment and the fixing device of Comparative Example 3, FIG. 26 illustrates the glosses of the images with respect to the density. A sufficient gloss was not obtained for the image output from the fixing device of Comparative Example 3 as compared with that of the image output from the fixing device 9 of this example. Moreover, FIG. 27 illustrates the graininess of each of the images with respect to the density. The image output from the fixing device of Comparative Example 3 exhibits the graininess equal to that of the image output from the fixing device 9 of this example. In the fixing device of Comparative Example 3, the entire temporarily fixed toner image tb was not pressed as in the case of the fixing device 9 of this example. However, since the temperature at the start of pressurization in the nip portion N3 of the pressure means 30 was low, the toner was solidified before the surface of the temporarily fixed toner image tb was sufficiently smoothed in the nip portion N3. As a result, only a part of the surface of the temporarily fixed toner image tb was smoothed. On the surface of the fixed toner image tc, a part deformed to be smooth by the pressurization with the pressure device 30 and a part remaining rough without being able to use the pressurization for deformation are present at a time (FIG. 23C). Since a part of the surface of the fixed toner image tc is rough, a sufficient gloss was not successfully obtained for the image output from the fixing device of Comparative Example 3 as in the case of the image output from the fixing device 9 of this example (FIG. 26). Moreover, since the toner is solidified before the surface of the temporarily fixed toner image tb is sufficiently smoothed when the pressurization is performed by the pressure device 30, the toner batter was not generated in the pressure device 30 for the image output from the fixing device of Comparative Example 3. Therefore, the image having the graininess equal to that of this example was obtained (FIG. 27).

Though the image deterioration such as the deterioration of graininess of the image containing the halftone, the thickening and blur of the thin line, and the degradation of visibility of the small point size character did not occur in the fixing device of Comparative Example 3, the image having a high gloss equal to that of the recording material P was not successfully output. Therefore, in order to improve the gloss of the toner image, it is effective to make the temperature of the toner image when the recording material enters the second nip portion higher than the temperature when the recording material exits from the first nip portion for heating.

Comparative Example 4

As Comparative Example 4, a fixing device having the following configuration is given. The fixing device of Comparative Example 4 also has the same configuration as that of the fixing device 9 of this example. However, in order to make T2 and T3 equal to those of Example 1 without using the noncontact heating device 24, the image was output while the surface temperatures of the fixing roller 11 and the pressure roller 12 of the heating/pressure device 10 were set to 200° C. At this time, T1=140° C., T2=120° C., and T3=73° C. were obtained.

For comparison of the effects between the fixing device 9 of this example and the fixing device of Comparative Example 4, FIG. 26 illustrates glosses of the images with respect to the density. A gloss of the image output from the fixing device of Comparative Example 4 was higher than that of the image output from the fixing device 9 of this example. Moreover, FIG. 27 illustrates the graininess of each of the images with respect to the density. The graininess of the image output from the fixing device of Comparative Example 4 was deteriorated as compared with that of the image output from the fixing device 9 of this example.

Figure 23D:
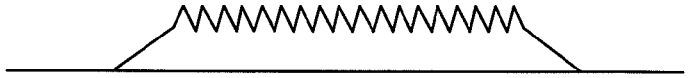
FIG. 23D is a view illustrating the temporarily fixed toner image after being heated and pressurized by the heating/pressure device of the fixing device of Comparative Example 4.
Figure 23E:
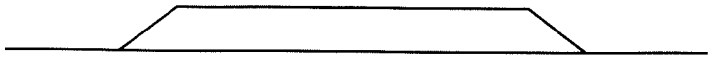
FIG. 23E is a view illustrating the fixed toner image pressed by the fixing device of Comparative Example 4.

In the fixing device of Comparative Example 4, the entire area of the surface of the temporarily fixed toner image tb was successfully sufficiently deformed to be smooth in the nip portion N3 of the pressure device 30 before the temporarily fixed toner image tb was solidified as in the case of the fixing device 9 of this example. However, the unfixed toner image ta was heated to the melting point of the toner or higher in the nip portion N1 of the heating/pressure device 10. As a result, the unfixed toner image ta was pressurized in a softer state than in Example 1 and was pressed (FIG. 23D). In the pressure device 30, the surface of the temporarily fixed toner image tb was smoothed without pressing the temporarily fixed toner image tb as in this example (FIG. 23E). From the image output from the fixing device of Comparative Example 2, a higher gloss than that of the image output from the fixing device 9 of this example was successfully obtained because the toner was pressed by the heating/pressure device 10 to increase the area of the toner image and the surface of the toner image was smoothed by the pressure device 30 (FIG. 26). Moreover, the toner batter occurs in the image output from the fixing device of Comparative Example 4 when the heating and the pressurization are performed in the heating/pressure device 10. Therefore, the graininess was more deteriorated than in this example (FIG. 27).

In the fixing device of Comparative Example 4, an image having a higher gloss than that of the recording material P was formed. However, the image deterioration such as the deterioration of graininess of the image containing the halftone, the thickening and blur of the thin line, and the degradation of visibility of the small point size character was brought about.

Comparative Example 5

Figure 28:
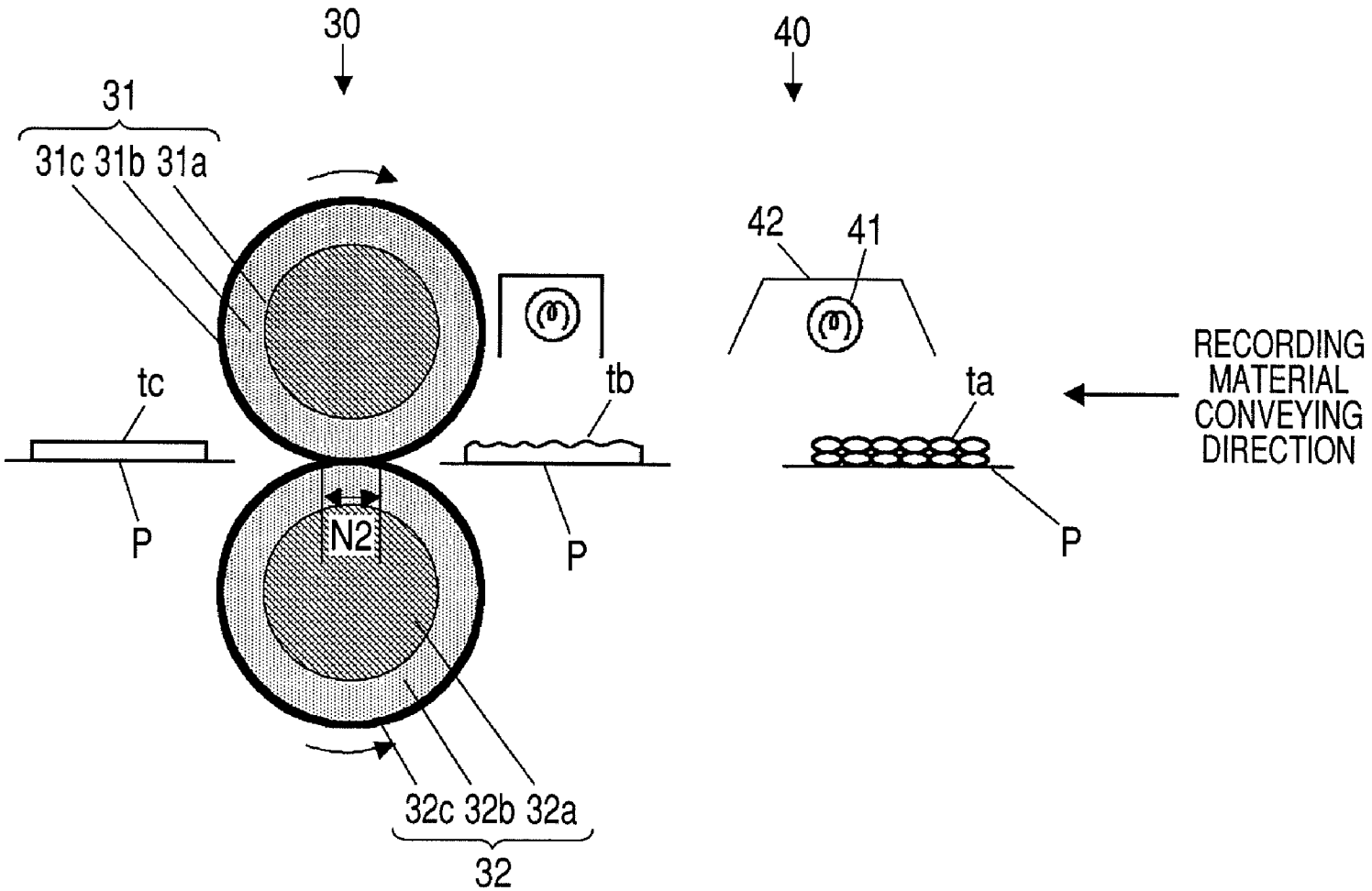
FIG. 28 is a schematic horizontal cross-sectional view of the fixing device of Comparative Example 5.

As Comparative Example 5, a fixing device having the following configuration is given. In the fixing device of Comparative Example 3, the noncontact heating device 24 is provided at the downstream of a flash fixing device 40 for performing temporary fixation in a noncontact manner and the pressure device 30 is provided at the downstream of the noncontact heating device 24 as illustrated in FIG. 28. At this time, T2=120° C. and T3=73° C. were obtained.

In the fixing device of Comparative Example 5, the gloss and the graininess were equal to those of the example. However, since the toner image was not pressurized when the temporary fixation was performed in the flash fixing device 40, an image inferior to that from the fixing device 9 of this example in fixability and in color mixture in a secondary color portion and a tertiary color portion was output.

As described above, the fixing device 9 of Embodiment 2 performs heating and pressurization without excessive heating in the heating/pressure device 10. After the heating in the noncontact heating device 24, the pressurization is performed in the pressure device 30. As a result, an image superior in gloss as well as in graininess was successfully output as compared with those from the fixing devices of Comparative Examples 3 and 4. Moreover, by performing the heating and the pressurization with the heating/pressure device, the image superior in fixability and color mixability to that of the Comparative Example 5 was successfully output.

This application claims the benefit of Japanese Patent Application Nos. 2007-146518, filed on Jun. 1, 2007, and 2008-139167 filed on May 28, 2008, which are hereby incorporated by reference herein in their entirety.

What is claimed is:

1. A fixing device, comprising:

a first nip portion forming unit for forming a first nip portion for nipping and conveying a recording material;

a second nip portion forming unit for forming a second nip portion for nipping and conveying the recording material having passed through the first nip portion, the fixing device being for heating an unfixed toner image on the recording material in the first nip portion and for glossing the toner image on the recording material in the second nip portion;

a temperature detecting section for detecting a temperature of the second nip portion forming unit;

a pressure force changing section for changing a pressure force applied to the second nip portion; and a control section for controlling the pressure force changing section, wherein a peak value of the pressure force in the second nip portion is set to 8 $kg/cm^2$ or lower, wherein a temperature of the toner image on the recording material drops from a temperature higher than a glass transition point of a toner to a temperature lower than the glass transition point within a period in which the toner image passes through the second nip portion, and wherein the control section controls the pressure force changing section to decrease the pressure force applied to the second nip portion as a detected temperature detected by the temperature detecting section becomes higher.

2. A fixing device according to claim 1, wherein the peak value of the pressure force in the second nip portion is set to 4 $kg/cm^2$ or higher and 7 $kg/cm^2$ or lower.

3. A fixing device according to claim 1, further comprising a heating section for heating the recording material in a non-contact state between the first nip portion forming unit and the second nip portion forming unit, wherein the heating section heats the toner image on the recording material to allow a temperature of the toner image when the toner image enters the second nip portion to be higher than a temperature of the toner image when heating is terminated in the first nip portion.

* * * * *